US009578938B1

(12) United States Patent
Verneuille

(10) Patent No.: US 9,578,938 B1
(45) Date of Patent: Feb. 28, 2017

(54) TRAVEL PREPAREDNESS SYSTEM

(71) Applicant: Robert Emile Verneuille, West Babylon, NY (US)

(72) Inventor: Robert Emile Verneuille, West Babylon, NY (US)

( * ) Notice: Subject to any disclaimer, the term of this patent is extended or adjusted under 35 U.S.C. 154(b) by 549 days.

(21) Appl. No.: 14/160,882

(22) Filed: Jan. 22, 2014

(51) Int. Cl.
*A45C 5/06* (2006.01)
*A45C 7/00* (2006.01)

(52) U.S. Cl.
CPC . *A45C 5/06* (2013.01); *A45C 7/00* (2013.01)

(58) Field of Classification Search
CPC ..... A45C 7/0036; A45C 7/0077; A45C 3/00; A45C 5/14; A45C 7/0095; A45C 5/04
USPC ..... 190/107, 101, 103, 111, 112, 108, 110, 190/18 A; D3/267, 279, 286, 287, 302, D3/303; 383/4, 110, 39; 220/553, 6, 7; 206/289, 315.1, 524.8, 581
See application file for complete search history.

(56) References Cited

U.S. PATENT DOCUMENTS 1,625,547 A 4/1927 Kessler
3,116,849 A 1/1964 Brewer et al.
3,371,771 A 3/1968 Bugyi
4,887,751 A 12/1989 Lehman
4,892,226 A * 1/1990 Abtahi ..... A45C 11/008 206/204
4,966,260 A 10/1990 Young
5,025,928 A 6/1991 Orsey et al.
5,150,776 A 9/1992 Rebenack
5,515,974 A 5/1996 Higson
5,755,180 A * 5/1998 Smith ..... A01K 13/00 119/165
5,873,504 A 2/1999 Farmer
6,116,045 A 9/2000 Hodosh et al.
6,179,102 B1 1/2001 Weber et al.
6,296,165 B1 10/2001 Mears
6,409,066 B1 6/2002 Schneider
6,505,479 B2 1/2003 Defelice et al.
6,582,124 B2 * 6/2003 Mogil ..... A45C 7/0077 383/110
6,957,738 B2 10/2005 Hammond
(Continued)

OTHER PUBLICATIONS

Becky Krystal, Kitted out for health on the road, The Washington Post Jan. 20, 2013, p. F6.
(Continued)

*Primary Examiner* — Fenn Mathew
*Assistant Examiner* — Cynthia Collado

(57) ABSTRACT

A travel preparedness system that generally comprises four components: a multifunction configurable case with multiple compartments, including at least one detachable compartment, with a carrying strap that can be attached to either the configurable case or the detachable compartment; a thermally insulated container; a plurality of commercially available resealable containers and an array of commercially available preparedness articles useful or necessary for a traveler. The preparedness articles are selected from a group of articles intended to aid a traveler to recover from a multitude of adversities, injuries or maladies, that also includes articles useful for entertainment and for the preparation, consumption and storage of food stuffs. The four components cooperate and, together with a method, prepare a traveler for emergency and non-emergency travel situations.

20 Claims, 15 Drawing Sheets

(56) References Cited

U.S. PATENT DOCUMENTS

| | | | | |
|---|---|---|---|---|
| 7,040,486 | B2 * | 5/2006 | Godshaw | A45C 5/005 132/312 |
| 7,232,018 | B1 * | 6/2007 | Salander | A45C 5/14 190/103 |
| 7,503,440 | B2 | 3/2009 | Gormick et al. | |
| 7,600,619 | B2 * | 10/2009 | Sapyta | A45C 7/0054 190/107 |
| 7,682,080 | B2 | 3/2010 | Mogil | |
| 7,854,317 | B1 | 12/2010 | Hebert et al. | |
| 8,043,004 | B2 | 10/2011 | Mogil | |
| 8,191,747 | B2 | 6/2012 | Pruchnicki | |
| 8,209,995 | B2 | 7/2012 | Kieling et al. | |
| 8,281,437 | B2 | 10/2012 | Hunkele | |
| 8,302,749 | B2 * | 11/2012 | Melmon | A45C 11/38 150/103 |
| 8,302,775 | B2 | 11/2012 | Holstein | |
| 8,348,510 | B2 | 1/2013 | Mogil | |
| 8,449,186 | B2 | 5/2013 | Bray | |
| 8,459,058 | B2 | 6/2013 | Mogil | |
| 8,496,106 | B1 | 7/2013 | Bigg | |
| 8,573,002 | B2 | 11/2013 | Leboux | |
| 8,622,235 | B2 | 1/2014 | Suchecki | |
| 8,708,351 | B2 * | 4/2014 | Kinskey | B25H 3/022 190/124 |
| 9,027,721 | B1 * | 5/2015 | Osborne | A45C 5/06 190/101 |
| 9,265,318 | B1 * | 2/2016 | Williams | A45C 11/20 |
| 2001/0037923 | A1 | 11/2001 | Godshaw | |
| 2002/0108828 | A1 | 8/2002 | Soskin | |
| 2004/0256283 | A1 | 12/2004 | Jasper et al. | |
| 2005/0121121 | A1 | 6/2005 | Wang | |
| 2005/0230936 | A1 | 10/2005 | Van Horne et al. | |
| 2005/0263528 | A1 | 12/2005 | Maldanado | |
| 2006/0168992 | A1 | 8/2006 | Robertson | |
| 2007/0102077 | A1 | 5/2007 | Parker-Ogden | |
| 2007/0156442 | A1 | 7/2007 | Ali | |
| 2008/0217281 | A1 | 9/2008 | Moeszinger | |
| 2009/0152159 | A1 | 6/2009 | Beeman | |
| 2010/0220468 | A1 | 9/2010 | Pearson | |
| 2011/0062051 | A1 | 3/2011 | Miller | |
| 2012/0240521 | A1 | 9/2012 | Johnson | |
| 2012/0255984 | A1 | 10/2012 | Pruchniki | |
| 2012/0266628 | A1 | 10/2012 | Kieling | |
| 2013/0001905 | A1 | 1/2013 | Vanderberg | |

OTHER PUBLICATIONS

Sky Mall Magazine, Emergency Preparedness with Relief Pod International Early Spring 2012 edition, p. 77.

Karst Sports, Internet site—Emergency Survival Kit http://www.karstsports.com/wiessukit.html?utm_source=googlepepla&utm_medium=adwords&id=18283950120&utm_content=pla&gclid=CNDL3M7sh7wCFStnOgodwIMAIA#.UtqEQPQo5ol.

REI Internet site—Examples of Emergency Kits http://www.rei.com/gear/feature/search/Google/Emergency%20Kits?s_kwcid=sCpgVBnN6_dc|pcrid|34213279685|pkw|trave/%20emergency%20kit|pmt|e|google|main&gclid=CI_Dsdnvh7wCFeHm7Aodll8AtQ.

* cited by examiner

2

2

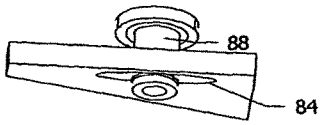
Fig.6
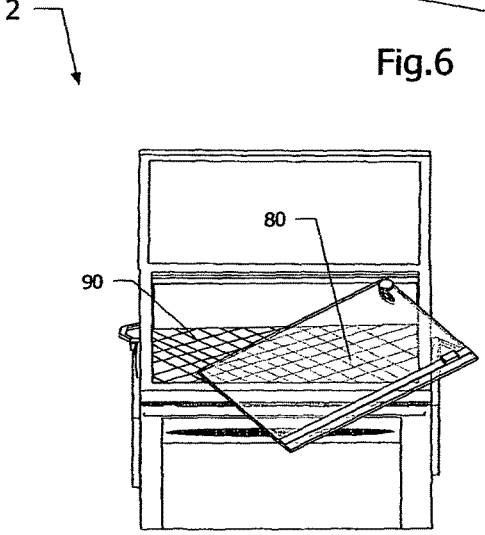
Fig. 7
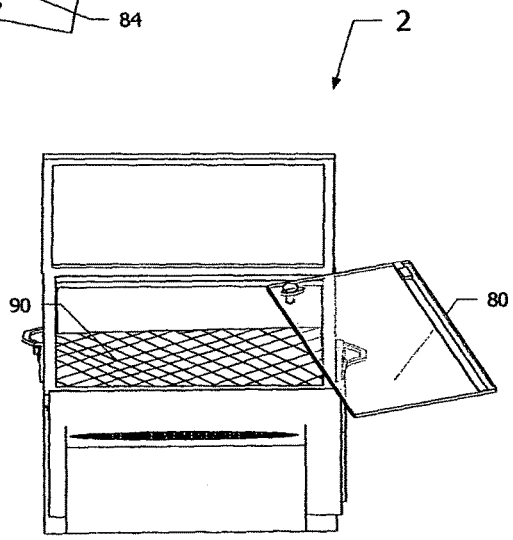
Fig 8
Fig 9
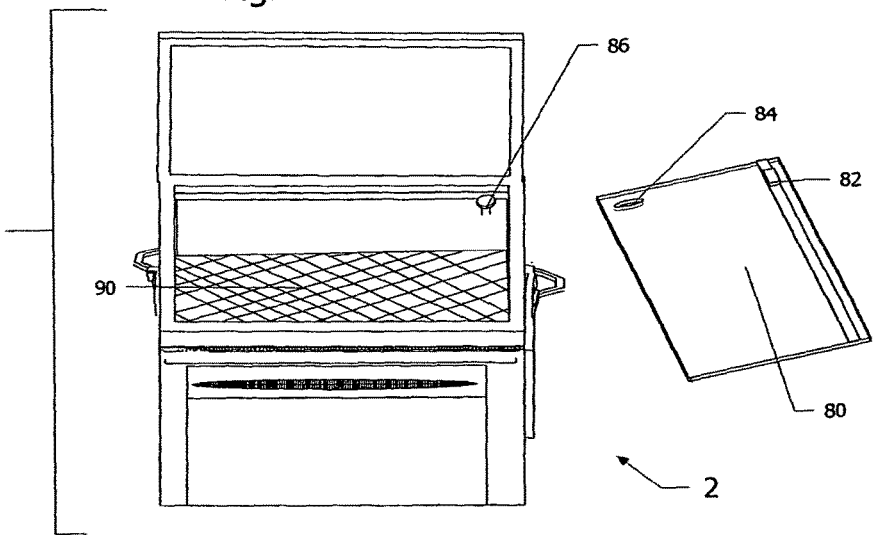

TRAVEL PREPAREDNESS SYSTEM

CROSS REFERENCE TO RELATED APPLICATION

The invention described and claimed herein below claims priority under 35 USC §120 from U.S. Provisional Patent Application 61/756,261 filed on Jan. 24, 2013, confirmation number 8670, which is incorporated by reference herein.

BACKGROUND OF THE INVENTION

The present invention relates generally to travel supplies, and more specifically it relates to a travel preparedness system which includes a configurable case with various compartments and supplies useful for travel. Hundreds of millions of people travel the world annually and whether a retired baby-boomer, a young adult, a parent vacationing with children or a business person, sometimes things go wrong and solutions are not readily available. Travel problems are not generally anticipated, in that, when preparing for a vacation, the average traveler is focused on the lure of a vacation experience and not the myriad of things that may go wrong, while a business traveler is generally focused on the business at hand, rather than preparing for potential disruptions. A traveler often does not anticipate problems that can occur when traveling and has difficulty responding to unexpected calamities. A traveler needs to be prepared, but few have the forethought to be prepared for all of the things that can go wrong.

Prior art reveals various collections of articles, generally contained within a case, commonly known as "kits," (which include first aid kits, emergency kits, rescue kits, safety kits and others). Kits found in prior art tend to contain items useful for emergencies related to vehicle, boating, camping, sporting events and other outdoor situations. Such kits generally contain items useful for more serious emergencies, while non-emergency travel kits tend to contain items useful for personal grooming or hygiene needs. Prior art and commercial advertising has not heretofore revealed any kit, pack or system or combination of articles that specifically addresses the multitude of minor problems that could affect a traveler. Neither has prior art revealed any kit, pack or system that includes a configurable multi-function case that is provisioned with a broad array of preparedness articles to aid a traveler recover from a broad range of non-emergency situations which may otherwise cause inconvenience, disruption or discomfort, nor any that also include articles intended to enhance a travel experience.

Travel kits have been the subject of prior art that has been improved for many years. In 1926, U.S. Pat. No. 1,625,547 was granted to Kessler for a travel emergency kit. Later in 1964, Brewer et al was granted U.S. Pat. No. 3,116,849, further improving said travel emergency kits. Recently Miller has claimed a first aid emergency preparedness kit, US Patent Application 20110062051. More recently, Holstein was granted U.S. Pat. No. 8,302,775, for a rapid deployment first aid kit. The components claimed by Miller and Holstein represent a wide array of first aid, germ control articles and medications included to assist with medical emergencies, but do not address the broad scope of non-medical problems.

Holstein includes a collection of emergency preparedness articles but does not include an electronic device power charger or a container suitable for food products or playing cards or dice. Holstein also includes water purification tablets suitable for outdoor survival, but does not provide devices or materials suitable for minor non-medical situations such as a sewing repair, broken eyeglasses or a damaged suitcase. Miller envisioned a broad range of activities for his emergency preparedness kit, but did not anticipate the needs of a traveler.

The concept of a soft-sided insulated container has been a regular subject of prior art covering hundreds of US Patent and US Patent Applications. Melvin Mogil holds many such patents and with U.S. Pat. No. 8,348,510 he defines a soft-sided insulated cooler bag that is collapsible. However, Mogil and all like prior art cases are not known to include features to assist a traveler, such as configurable, multiple use, resealable containers, nor does Mogil include a detachable compartment that acts as an independent case that is clipped to a belt or luggage strap or configured as a waist pack or shoulder bag. Hence, Mogil, Miller, Holstein and all others fail to include a configurable case provisioned with a broad array of travel preparedness articles as are herein below defined.

SUMMARY OF THE INVENTION

In view of the foregoing disadvantages inherent in the known types of travel preparedness articles that now exist in the prior art, the present invention provides a new travel preparedness system that combines, within a multi-function configurable case many items that are useful for travel, wherein the same can be utilized for improving the travel experience.

The general purpose of the present invention, which will be described subsequently in greater detail, is to provide a new travel preparedness system that combines the advantages of travel supplies mentioned heretofore with many novel features that result in a new travel preparedness system which is not anticipated, rendered obvious, suggested, or even implied by any of the prior art travel supplies, either alone or in any combination thereof.

To attain this my travel preparedness system generally comprises four components: a multifunction configurable case with multiple compartments, including at least one detachable compartment, with a carrying strap that can be attached to either the configurable case or the detachable compartment; a thermally insulated container; a plurality of commercially available resealable containers and an array of commercially available preparedness articles useful or necessary for a traveler. The preparedness articles are selected from a group of articles intended to aid a traveler to recover from a multitude of adversities, injuries or maladies, that also includes articles useful for entertainment and for the preparation, consumption and storage of food stuffs. The four components cooperate and, together with a method, prepare a traveler for emergency and non-emergency travel situations.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways.

In an aspect of the invention there is a configurable case comprising at least one main container. The main container comprises a plurality of walls that are defined by a geometric shape of the container and a bottom section that form an outer shell of the main container and enclose an internal volume. Handle rings are affixed to the exterior surface of opposing walls of the main container. A contiguous rim is defined at distal vertical edges of the plurality of walls in the upper portion of the outer shell. The main container includes at least one fixed compartment that extends outward from one or more of the walls such that an exterior surface the walls define the back wall of the fixed compartments. The fixed compartments open to provide access to an internal volume.

The main container also includes a plurality of detachable compartments. The detachable compartments include four walls rising from, and perpendicular to a common substantially flat sturdy bottom section and top section that define an enclosed internal volume which opens to provide via an opening means. Detachable compartments include handle rings on opposing walls. The back wall of the detachable container includes a tongue. The tongue comprises a rigid material, of sufficient size and durability such that, when the tongue is urged into a vertical shaft established in the region between layers of the main container wall via a horizontal slot cut into an outer surface of a main container wall, a firm connection is established between the detachable compartment and the main container. The tongue facilitates easy removal while remaining securely attached to the main container when not so disposed. The detachable compartment acts ans an independent container or by means of the tongue is alternatively clipped to a waist belt or luggage strap. The present invention is satisfied if the detachable compartment is not attached to one of the walls of the outer shell but instead is removable, in that, a removable compartment is loosely stored within a compartment of the configurable case.

The configurable case includes a cover assembly that acts as a cover for the main container. The cover assembly is hingedly attached to the main container. The cover assembly includes a bottom section and a cover flap. The bottom section comprises a layer of insulating material sandwiched between an inner layer and a water resistant outer layer. The water resistant outer layer abuts the upper edge of the main container realizing a fully enclosed compartment when the cover assembly is in the closed position. The cover flap comprises multiple layers of material, within which, a pouch is defined within a pocket between the multiple layers such that an opening in the cover flap allows access to the internal volume of the pocket. The cover flap acts as a closure for the inner cover container.

The cover assembly inner cover container comprises a plurality of walls defined by a geometric shape of the container and a thermally insulated bottom section like the main container, and further includes a cover flap which is hingedly attached to the cover container to both cover and allow access to the internal volume of the cover container. The cover container includes a flexible mesh pocket connected to the bottom section. The cover container also includes a pivotally affixed, removable clear bag with a slidable closure and a button hole. The clear bag comprises a one quart transparent flexible plastic bag. The clear bag is connectable via a button hole to a button attached to a raised post affixed to the bottom section of the cover container. The clear bag pivots around the button beyond the boundaries of the cover container.

The configurable case also includes a lifting means, comprising a handle assembly that includes: a flexible, adjustable and detachable handle, an adjusting device for adjusting the length of the handle, a connecting device for connecting the handle assembly to the handle rings. The configurable handle assembly connects to the handle rings affixed to opposing main container walls and is transferrable to the handle rings affixed to opposing detachable compartment walls. The handle assembly enables the configurable case is hoisted by a person and carried in reliance on the lifting means.

The travel preparedness system has walls and bottom section comprising materials selected from the group consisting of non-woven and woven flexible plastic, pliable woven fabric and durable woven fabric. The wall structure is semi-flexible such that configurable case remains erect when unsupported.

The thermally insulated compartment is integral to the configurable case, such that insulating material, such as foil or foam is sandwiched between a water resistant interior liner effecting thermal insulation inner layer and the outer shell of the main container. The liner of the thermally insulated compartment is a flexible, water-resistant material selected from the group of material comprising plastic, vinyl, polyvinyl, rubber and combinations thereof. Said liner is constructed of one contiguous piece of material that is folded within the container in a manner that eliminates or minimizes seams, while maintaining the water resistance of the compartment. The liner includes a flange at the upper distal edge that is attached along the contiguous rim and covers all exposed surfaces of the insulation. The thermally insulated function of the travel preparedness system is satisfied if the thermally insulated compartment exists as an independent, removable, thermally insulated container further acting as a removable liner for the main container. The thermally insulated container, when disposed as an independent, removable, thermally insulated container, includes handle rings.

The walls of the semi-flexible main container are collapsible. A bottom portion of the main container walls fold along a plurality of predefined folds in order to enable folding along the predefined folds to reduce a vertical height and an internal volume of the main container and by extension the configurable case thus realizing a smaller container. The folds of the configurable case are secured with a retainer to maintain the reduced internal volume of the collapsed walls, so that removing the retainer allows the container to be expanded against the folds to maximize the internal volume.

The preparedness articles are organized and arranged within the configurable case within a plurality of resealable containers. Articles are contained within resealable plastic bags that act as liners for the resealable containers. The resealable plastic bags also serves to keep the resealable containers clean, such that the resealable containers are configurable for containing liquid or dry food stuffs and cooperate with the insulated compartment to maintain any food stuff container therein.

Commercially available preparedness articles include: rain gear, such as hooded ponchos; a portable illumination device; a portable USB electronic device charger; sewing supplies including needles, threads of various colors, buttons, and scissors; eye glass repair supplies including nose pads, small screws, a small flat head screwdriver and cleaning cloth; a multifunction tool including at least flat and phillips head screw drivers; bottle and can opener; a cutting device and pliers; a roll of adhesive cloth tape, often known as duct tape; a tube of cyanoacrylate glue, commonly known as super glue; a bungee cord, which may be of varying lengths; first aid supplies including: a plurality of band aids, antiseptic ointment, gauze and tape; personal care supplies including hair ties, finger nail clippers, toe nail clippers and a mirror; non prescription medications including individually packaged medications such as: bismuth subsalic, loperamide, loratadine, and analgesic pain relievers; a plurality of air filtering face masks; a plurality of protective gloves; commercially available hand sanitizer; a plurality of plastic cutlery; a plurality of various sized flexible resealable plastic bags; a deck of playing cards; plural dice; writing paper; a writing instrument and written instructions, including a method of use and operation of the system, travel tips and game playing instructions.

The travel preparedness system, in a native configuration comprises the semi-flexible case configured to the smallest compressed state with the retainers fastened so that the case fits within luggage. The handle assembly is stored within an exterior compartment. Liquid articles selected from the array of preparedness articles are inserted within the one quart clear plastic bag. Rain gear is positioned within the mesh pocket directly under the clear plastic bag. Restricted articles such as the multifunction tool are configured within the detachable compartment. The portable illumination device and first aid supplies are configured within one of the exterior compartments.

In one configuration the case is expandable to include an additional internal volume allowing for the storage of larger articles. The case is configured to act as case as carry-on luggage with the inclusion of an adjustable handle assembly, such that it becomes a carry case. The handle assembly configurable for use as a shoulder bag or hand bag.

The detachable compartment is configurable as a separate case when detached from the case and the handle assembly is transferred to the detached compartment enabling a small detached carry case. The detached case is also configurable as a miniature preparedness kit, in that, a traveler has the option to select a subset of preparedness articles pertinent to immediate travel requirements. With this configuration articles that are restricted from commercial air travel are transferred to the main configurable case and stored within checked luggage, while the detachable compartment acting as a miniature preparedness kit is carried onto a commercial air flight. Conversely, a restricted article may reside or be placed into the detachable compartment with the intent of removing the detachable compartment for storage within checked luggage so that the remainder of the configurable case is usable as carry-on luggage.

Preparedness articles include articles useful to when something becomes damaged, such as, using a bungee cord for effecting a temporary repair to luggage or an article other than luggage; using eyeglass repair supplies to repair broken eye glasses or sunglasses; mending clothing with sewing supplies and a broken suitcase, using, duct tape, super glue, a bungee cord and a multifunction tool. Preparedness articles from different species cooperate of various purposes such as first aid, in that, applying super glue (a repair article), to close a serious cut or wound and covering the wound with gauze (a first aid article), wrapping the wound with duct tape (a repair article), cutting the duct tape, with scissors (a sewing article) and if required stabilizing or slinging an appendage such as an arm with a bungee cord (a repair article), or gaining visual access to a wound beyond the normal field of vision with a mirror (a personal article) and making a hot or cold compress for soothing an injury using one of a supply of resealable plastic bags and water obtained from an available water source.

Foul weather adversities are mitigated by the using rain gear and protecting personal property from wet weather using resealable plastic bags. Environmental or biological travel hazards are mitigated using articles such as hand sanitizer, hand protection gloves and air filtering masks singularly or in concert with other articles. Delays during travel, inclement weather, or general down time, the travel experience is made more enjoyable with articles such playing cards or dice or using a writing instrument and note paper for drawing or composing.

At times during travel electrical power is unavailable. In this age of dependency on portable electronic devices, loss of power and the inability to charge portable electronic devices can have a devastating affect on a traveler. A portable illumination device and an electronic device charger that uses dynamo power generated by cranking or squeezing the device are included. An included travel tip suggests using the illumination device to inspect a hotel room for bed bugs by shining the light from a portable illumination device into drawers and the corners of bedding causing bed bugs to scurry and be noticed.

In another aspect of the invention, the case is configured for use as a portable thermal insulated cooler maintaining foods stuffs at a hot or cold temperature. Removing the resealable containers from the internal volume and making ice packs with available ice using one of a supply of resealable plastic bags further supports the cooler function for eating. Combined with food bowls plastic cutlery, moistened towlettes and additional flexible resealable bags further supports the preparation, consumption, cleanup and storage of food. Configuring the travel preparedness system to support eating provides a travel the option to save money while enjoying a meal in hotel room. It should be appreciated that when a resealable plastic bag is removed from a container, articles stored within the resealable clear plastic bag remain confined, so that the resealable clear plastic bag may exist separately in a drawer or on furniture.

The foregoing configurations include a method of reducing the configurable case to a small size for storage or expanding it for use as a carry-on bag by respectively compressing or expanding predefined folds. Another method includes ready content access by lifting the cover flap of the cover assembly to an open position, exposing and pivoting the clear bag holding the liquid containers beyond the boundaries of the configurable case thereby exposing the liquid containers to security personnel or, as required, removing the clear bag from the cover assembly.

It should be appreciated that the rectangular configurable case, as depicted, is arbitrary, as is the defined front and back portions, such that the travel preparedness system supports other geometric shapes. There are many variants to the illustrative embodiment of the invention. In a preferred embodiment, the case is more visually pleasing when adorned with colors, textures or other design elements, and the inventor believes that a multitude of options exist that would enhance the aesthetic appearance of the present invention without the need to change any of the structural or configurable characteristics of the travel preparedness system. In other embodiments the clear bag is connected with a carabiner or placed in a compartment, or the clear bag may include a slidable closure, or a different fastener such as a zipper is used as a retainer to secure the configurable case in a collapsed position, or the portable illumination device and the portable USB electronic device charger exist as separate devices or the devices may alternately be solar-powered, utilize batteries, or be a combination device which also includes a radio.

It should also be appreciated that the benefits of the travel preparedness system extend to situations not involving travel and should not be construed as to limit the scope of the present invention, such that the benefits of the present invention extend to a home or office environment and is equally useful if kept in an automobile. The specifications herein defined are not set forth as a fully exhaustive representation as to limit the invention whereby modifications and alternative arrangements may be devised, by those skilled in the art, without departing from the spirit of the present invention. Hence, my travel preparedness system improves on the limited scope of prior art, thus defining a new improved travel preparedness system.

BRIEF DESCRIPTION OF THE SEVERAL VIEWS OF THE DRAWINGS

The aspects of the invention may be readily understood with the aid of illustrative figures and detailed description included herein below, which embody the various aspect of the invention provided by way of illustration, but not of limitation, of the present invention, and in which the following specifications and drawings illustrate a preferred embodiment of the present invention, providing a conceptual view intended to convey the spirit of the invention. Drawings are not necessarily drawn to scale and should not be construed to define specific proportions.

Sheet 1

Sheet 2

Figure 2:
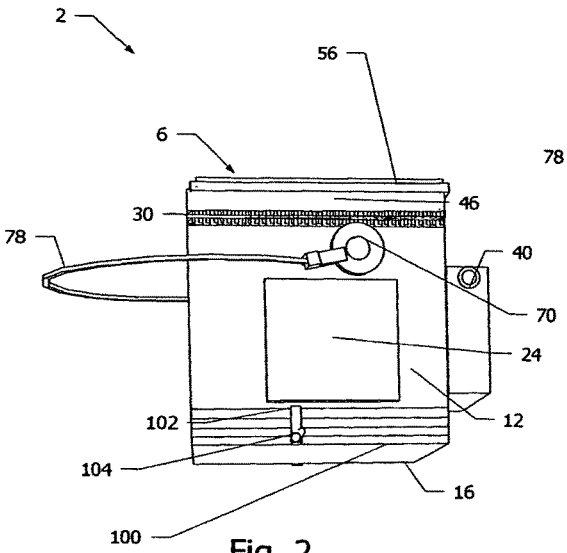

FIG. 2 Travel case—closed position perspective view

Figure 3:
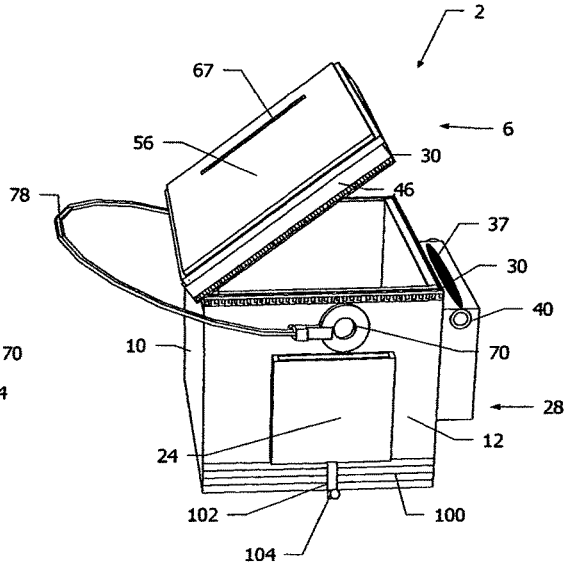

FIG. 3 Travel case—cover assembly open perspective view

Figure 4:
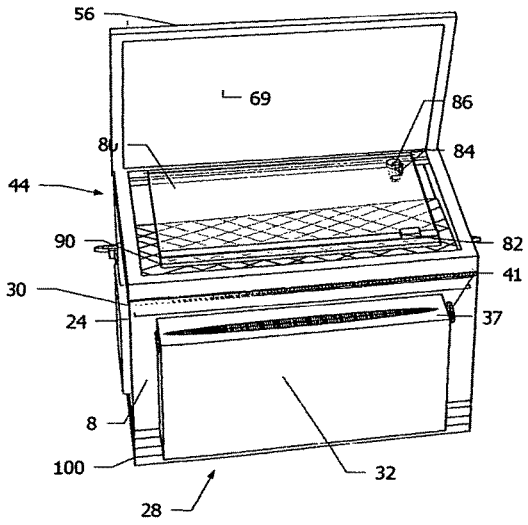

FIG. 4 Travel case—cover assembly and cover flap open—perspective view

Figure 5:
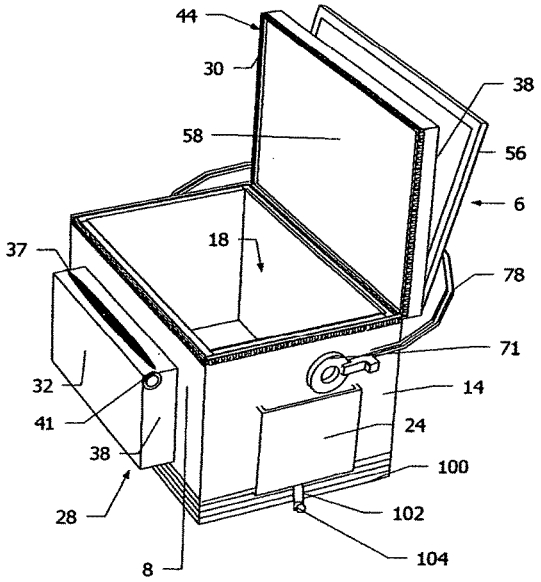

FIG. 5 Inner cover container open exposing clear bag—perspective view

Sheet 3

FIG. 6 Clear bag button assembly—enlarged perspective view

FIG. 7 Pivotal motion of clear bag—perspective view

FIG. 8 Pivotal motion of clear bag—perspective view

FIG. 9 Pivotal motion of clear bag—perspective view

Sheet 4

Figure 10:
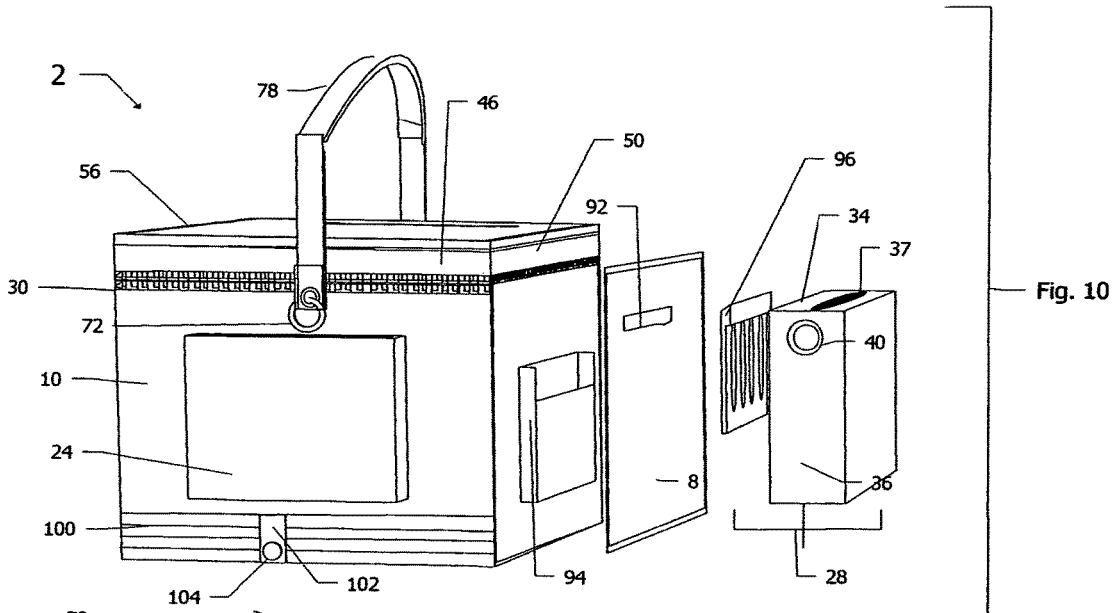

FIG. 10 Detachable pocket detail—tongue and slot exploded—perspective view

Figure 11:
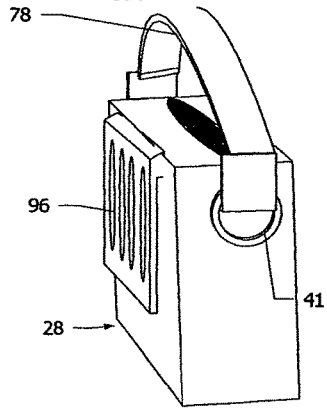
Figure 12:
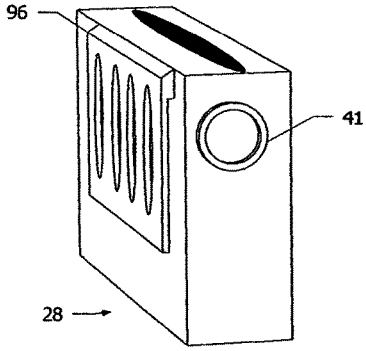

FIG. 11 Detached case with tongue shown attached to a strap—perspective view FIG. 12 Detached case with attached handle shown—perspective view Sheet 5

Figure 13:
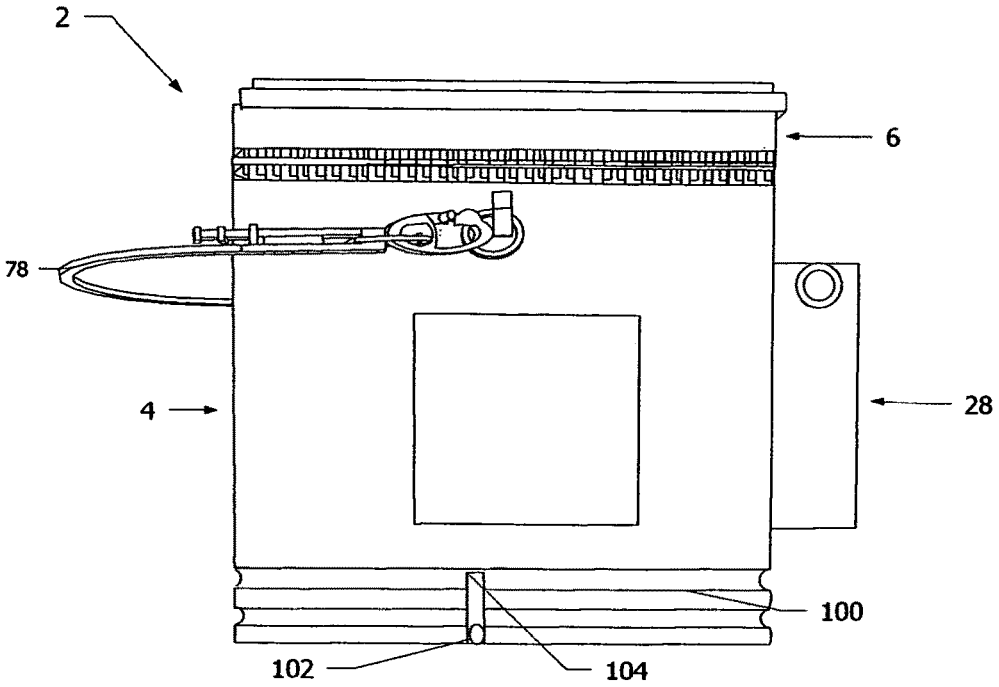

FIG. 13 Configurable case collapsed to smallest size—perspective view

Figure 14:
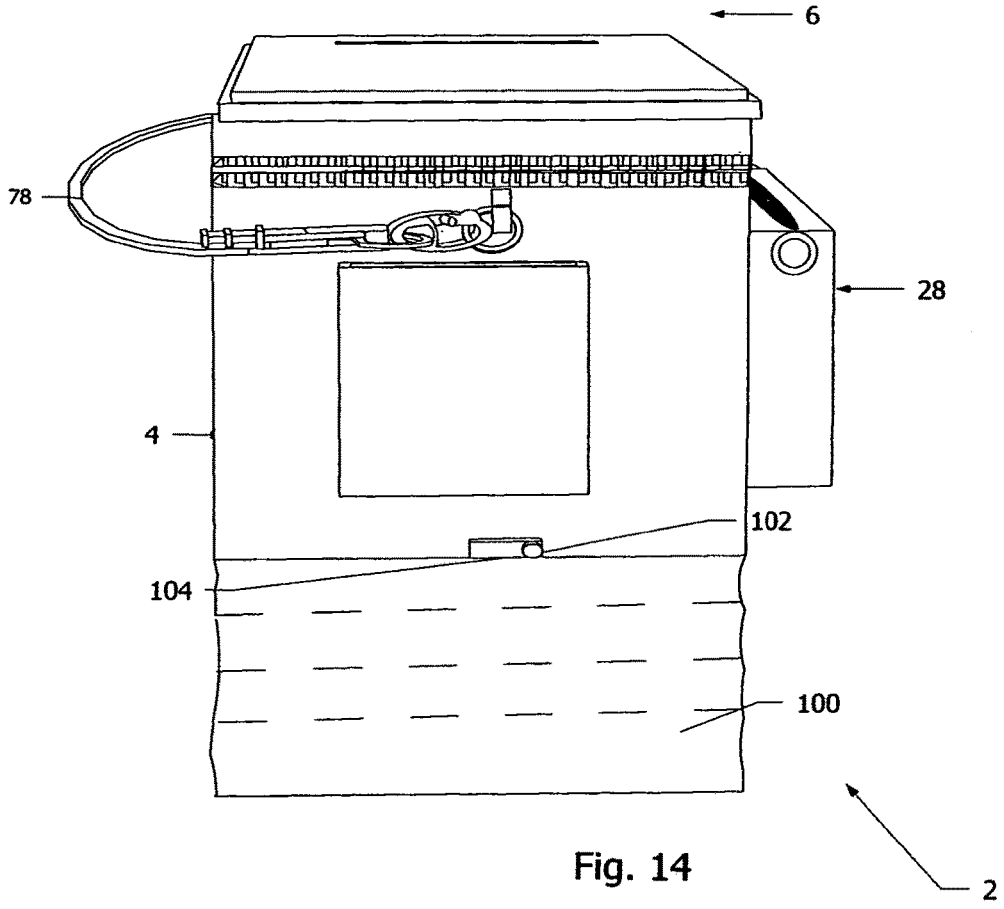

FIG. 14 Configurable case expanded to largest size—perspective view

Sheet 6

Figure 15:
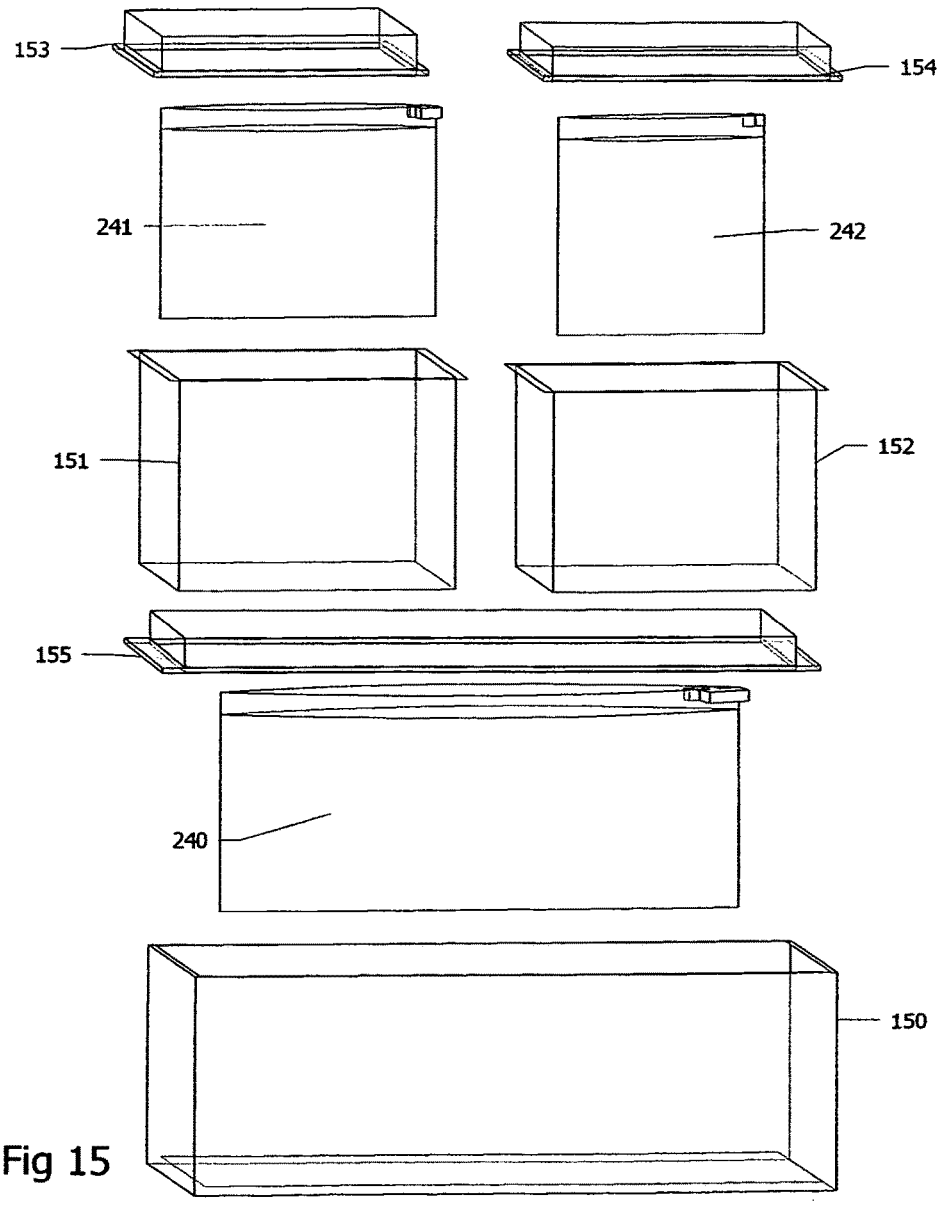

FIG. 15 Resealable container with plastic bag liners—enlarged perspective view Sheet 7

Figure 16:
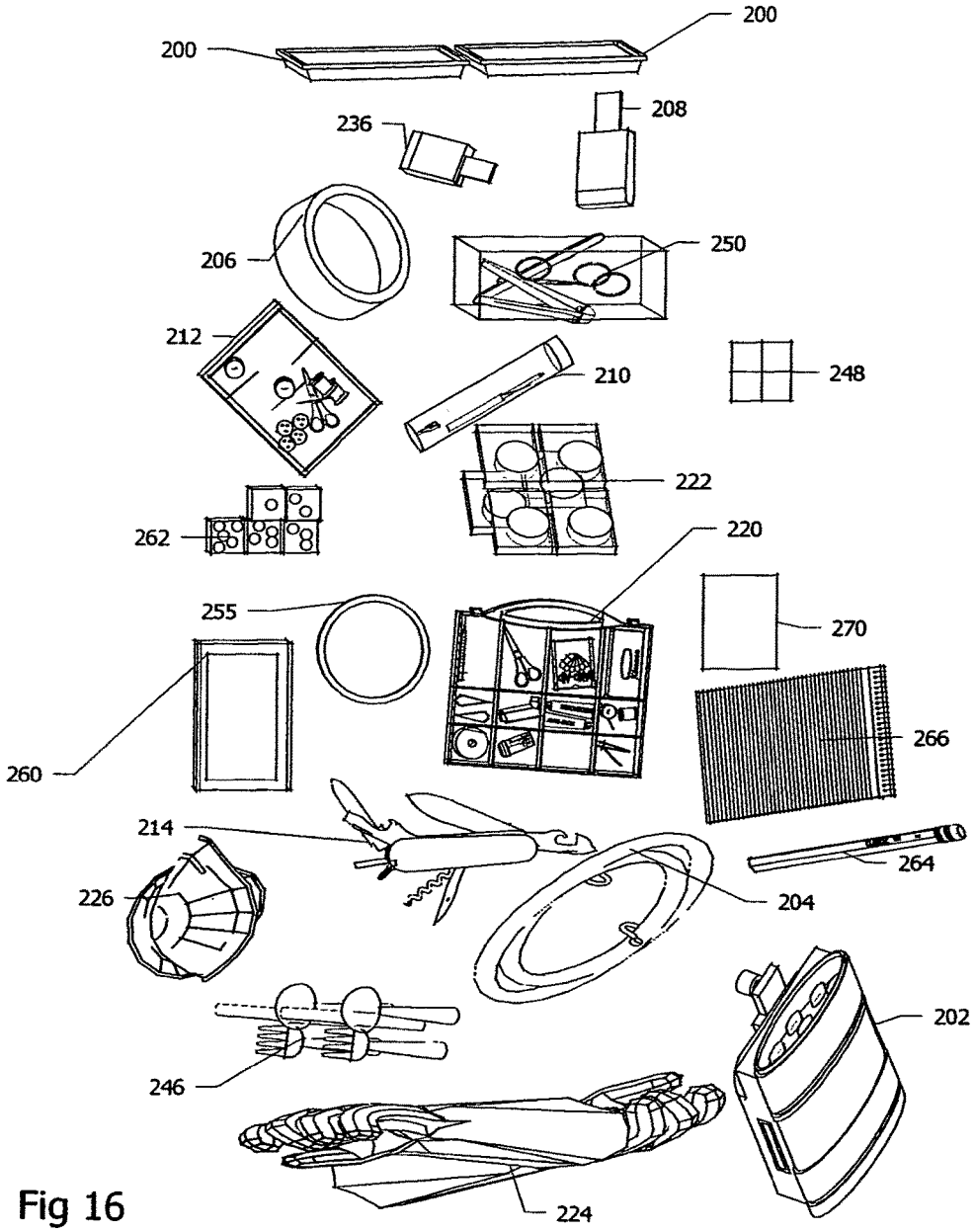
Figure 17:
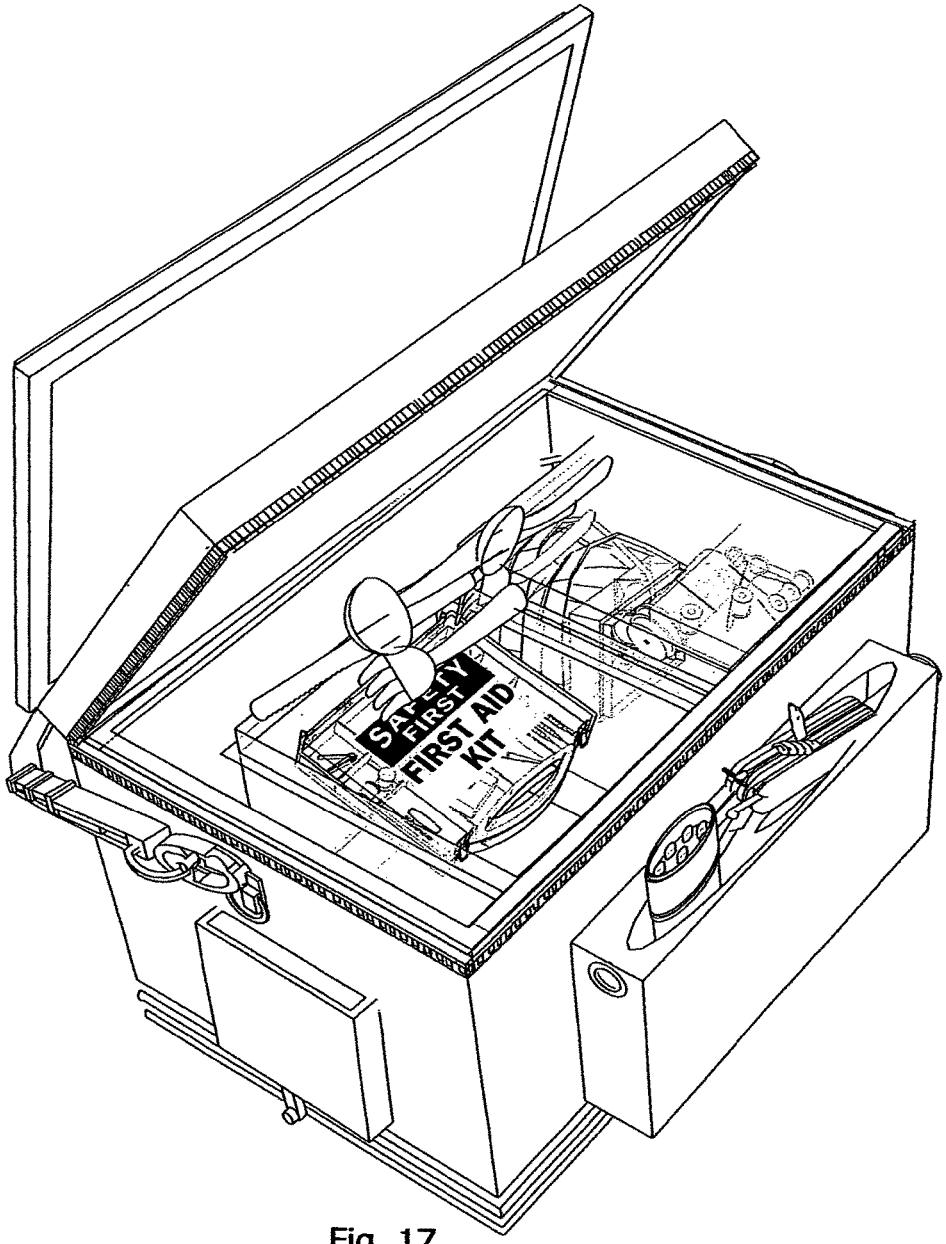

FIG. 16 Preparedness articles—enlarged perspective view

Sheet 8

FIG. 17 Cover view

Sheet 9

Figure 18:
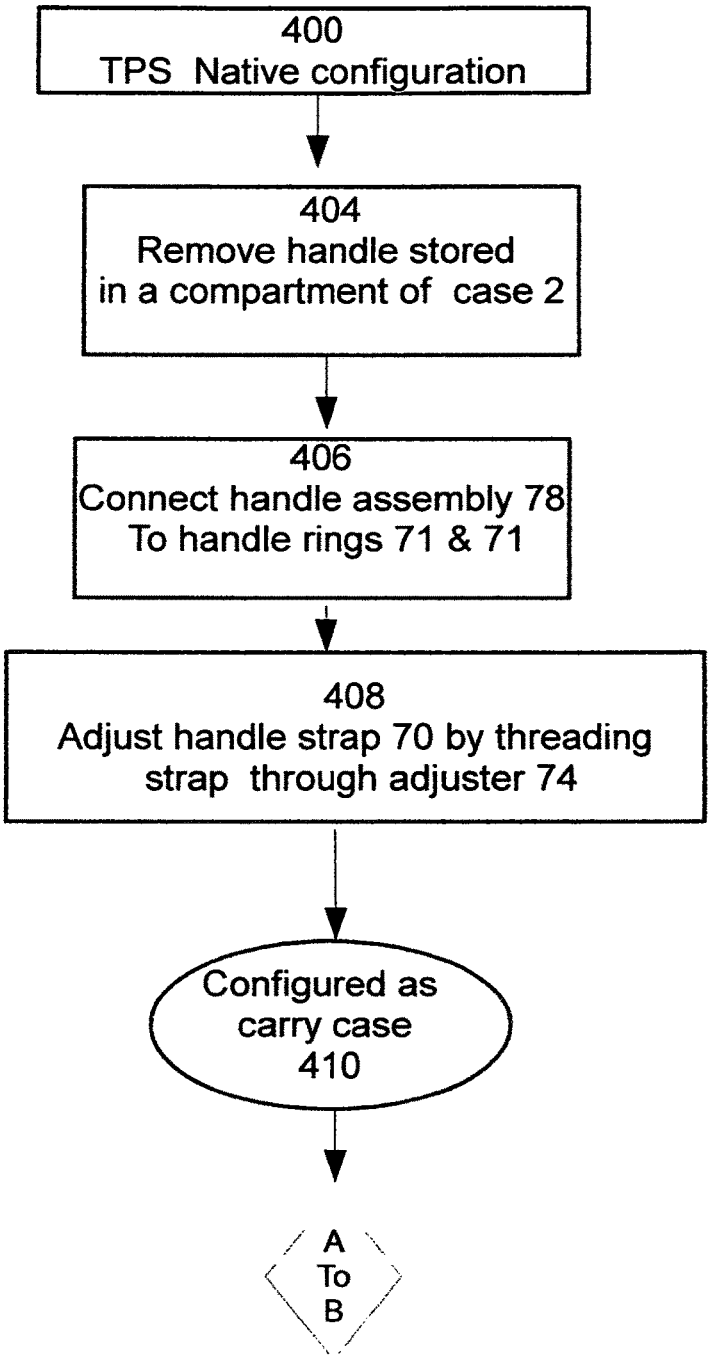

FIG. 18 Connect handle assembly

Sheet 10

Figure 19:
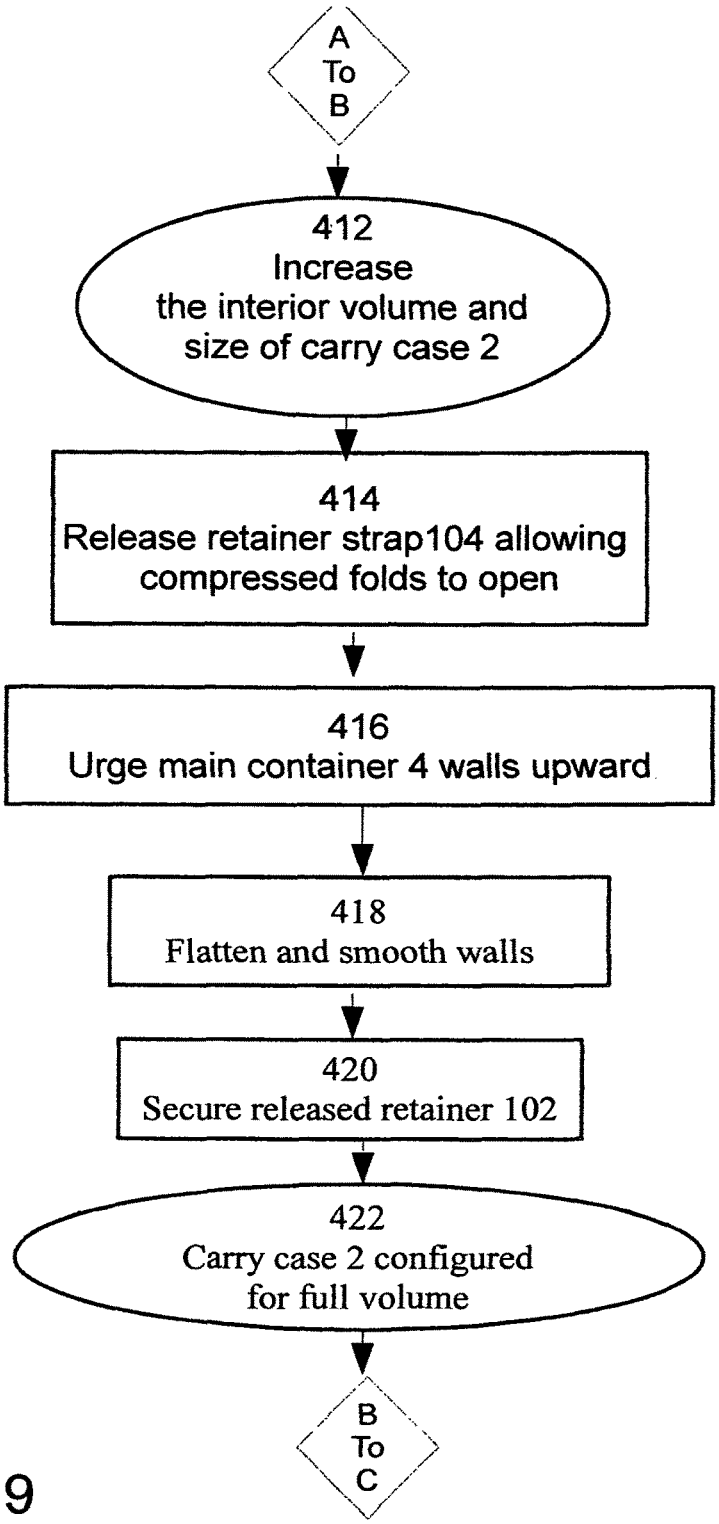

FIG. 19 Increase internal volume and size of configurable case 2

Sheet 11

Figure 20:
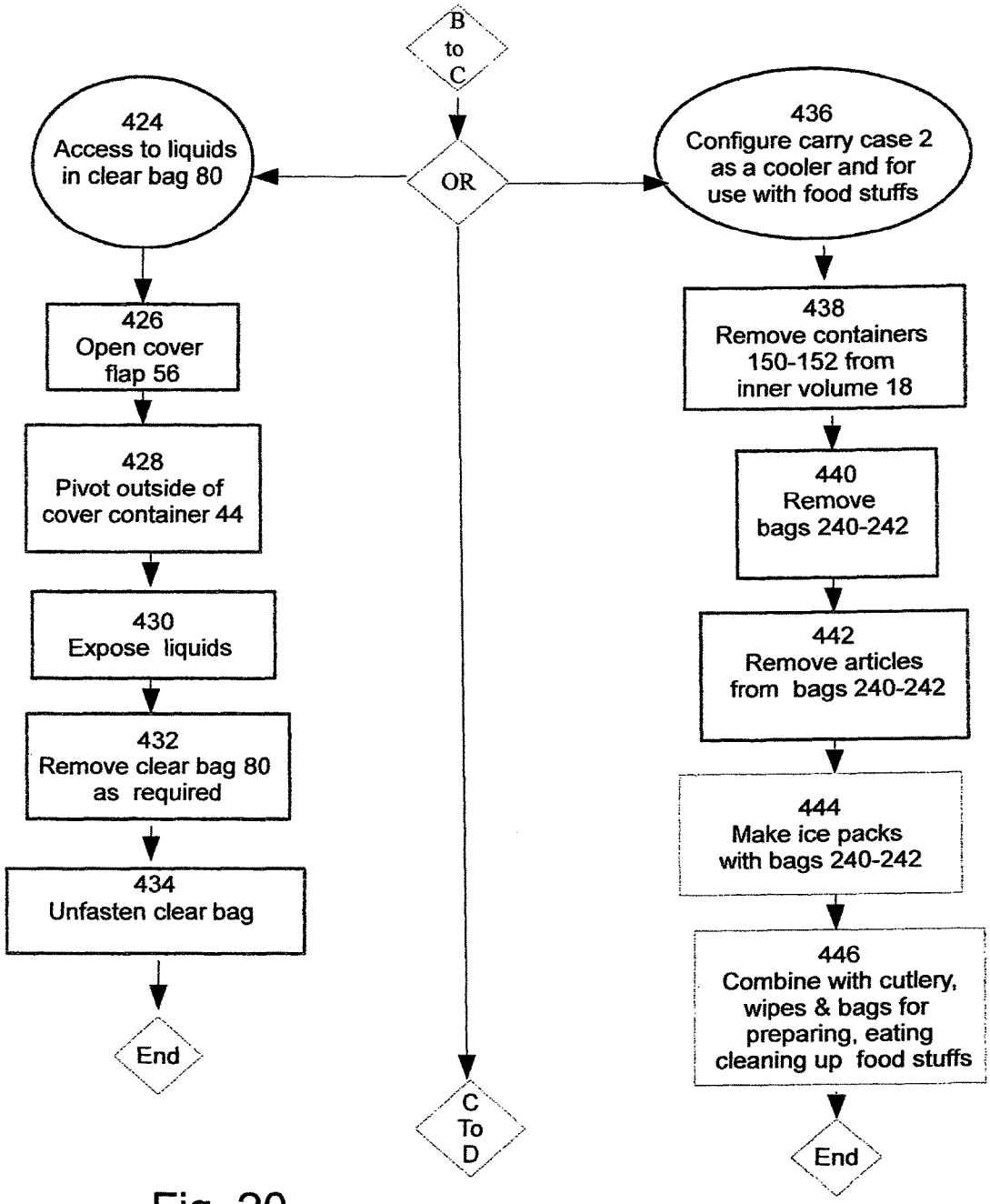

FIG. 20 Content access for liquids/configure as cooler

Sheet 12

Figure 21:
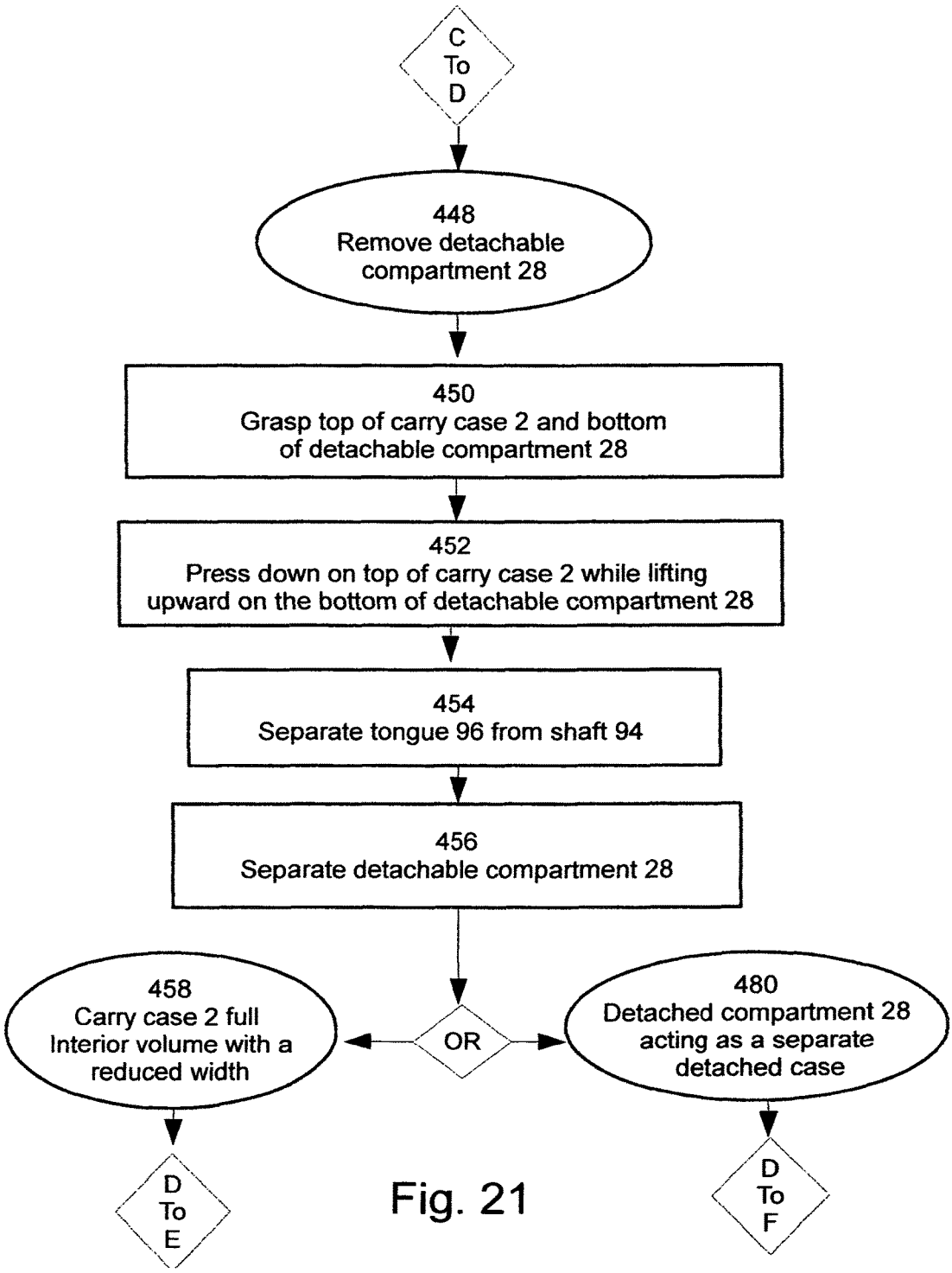

FIG. 21 Remove detachable compartment 28

Sheet 13

Figure 22:
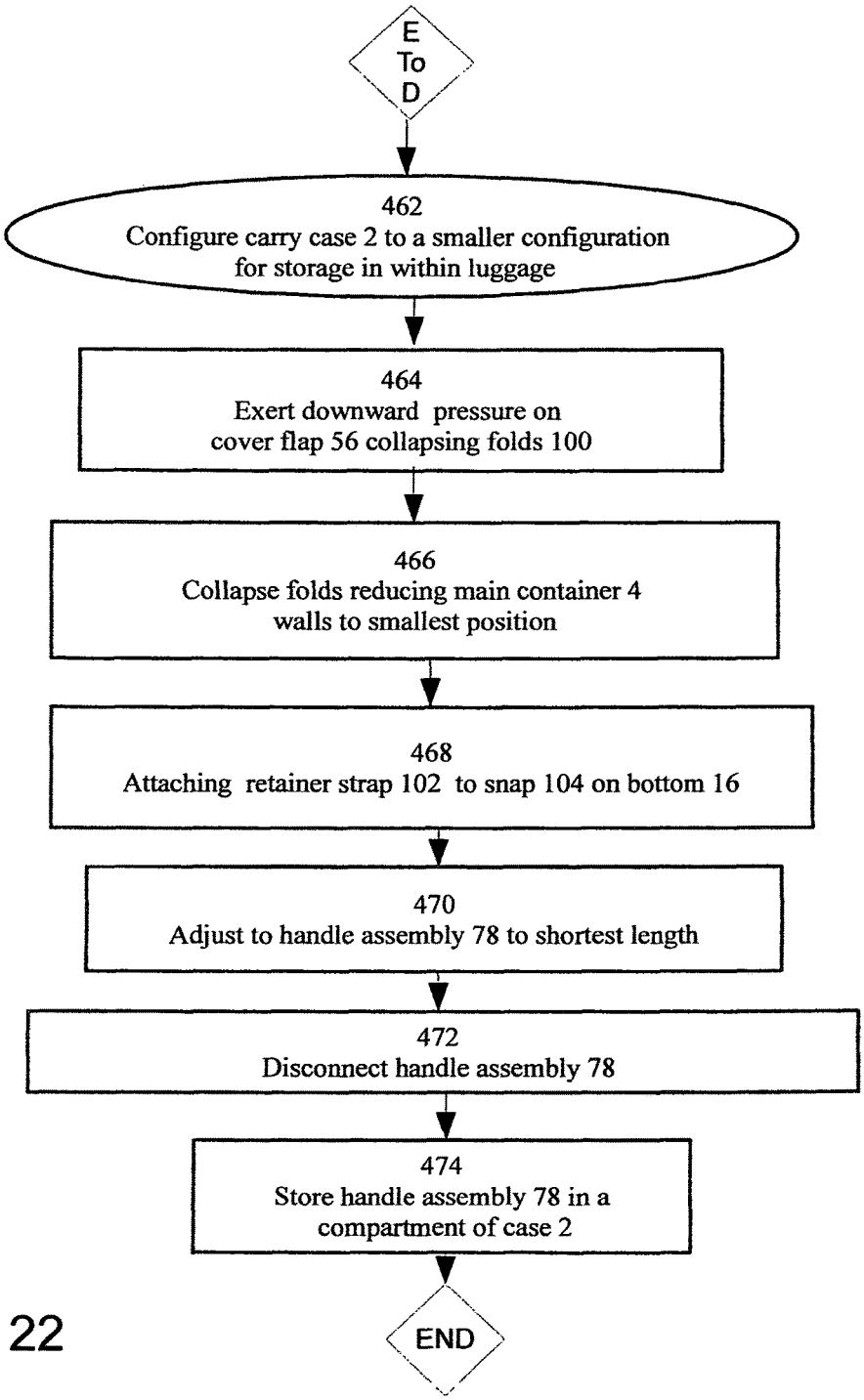

FIG. 22 Configurable case 2 to a smaller configuration for storage

Sheet 14

Figure 23:
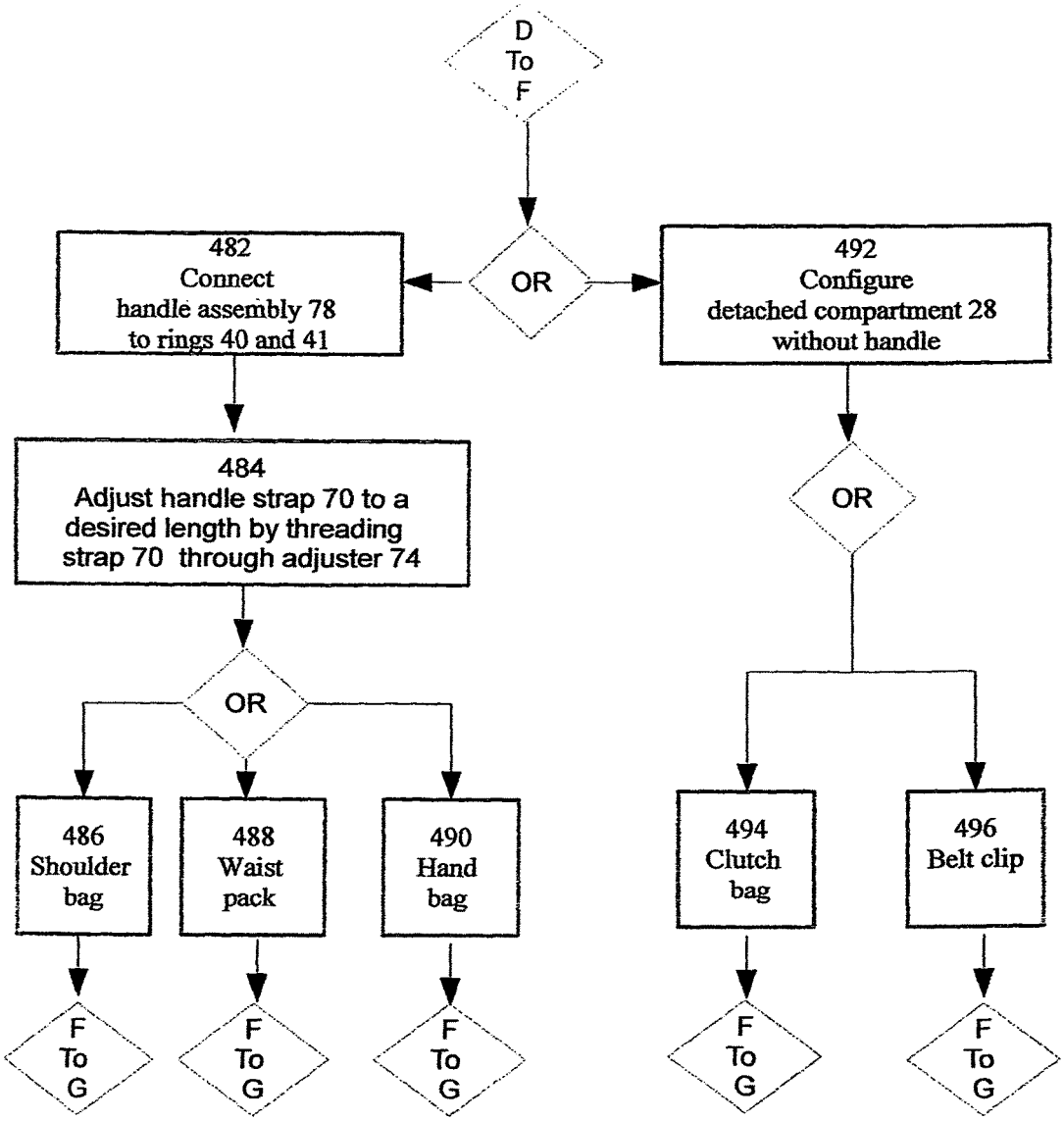

FIG. 23 Configure detachable compartment 28 acting as a separate case

Sheet 15

Figure 24:
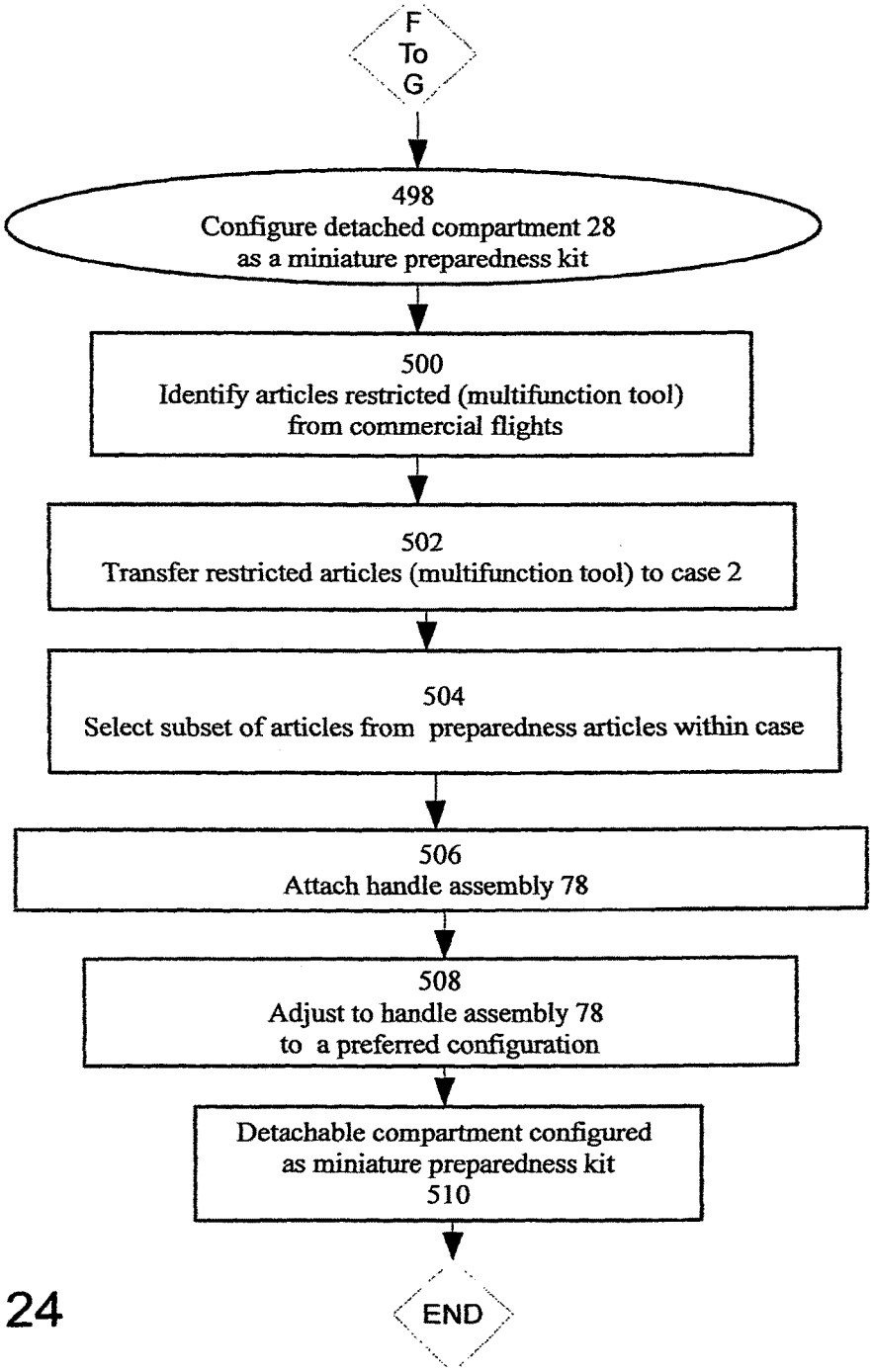

FIG. 24 Configure detachable compartment 28 as miniature preparedness kit

DETAILED DESCRIPTION OF THE INVENTION

Figure 1:
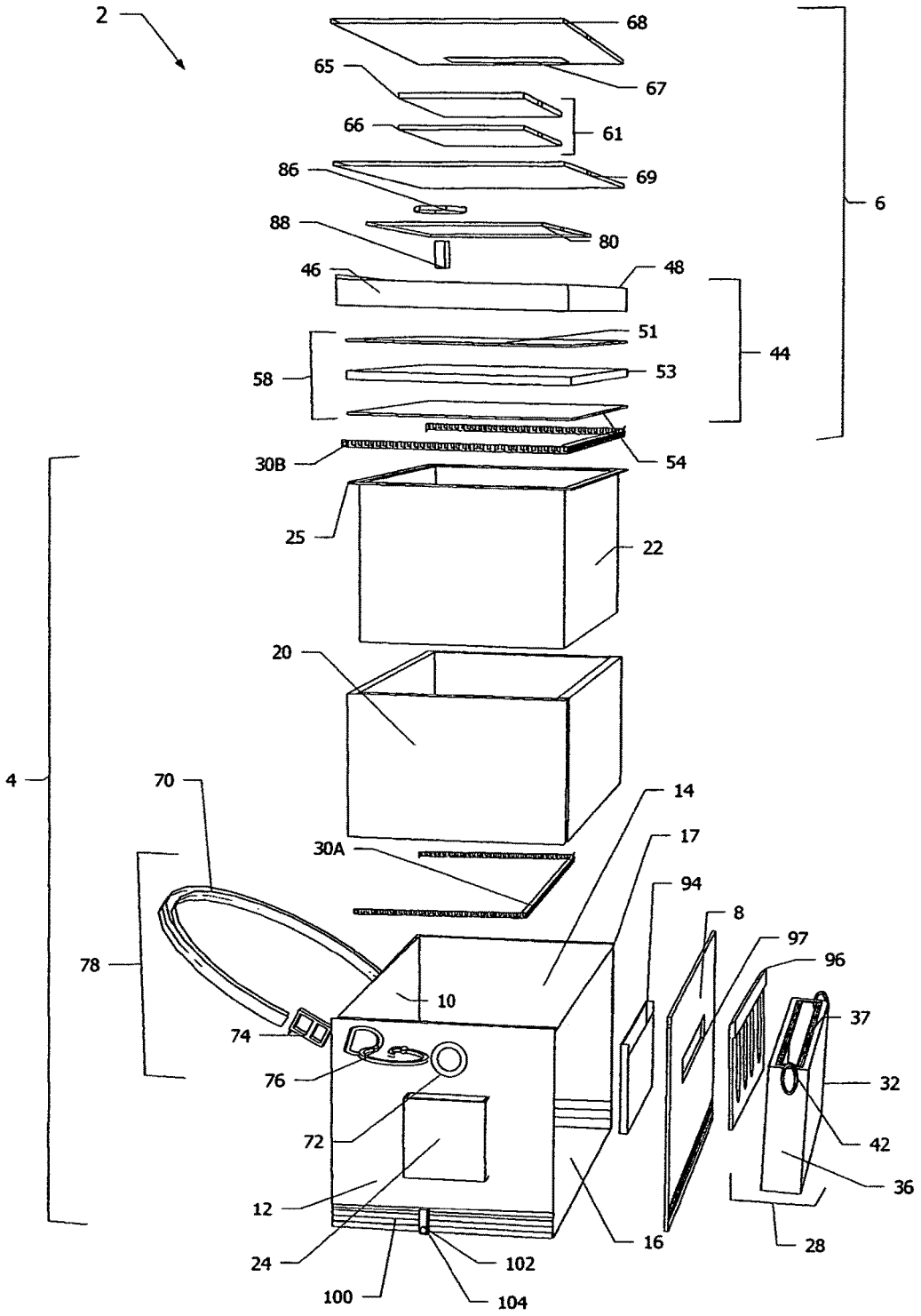
FIG. 1 Travel case—partially exploded perspective view

FIGS. 1 through 24 show a travel preparedness system in several configurations. FIG. 1, with an exploded view, depicts one preferred embodiment of the travel preparedness system that includes a configurable case 2 comprising first a main container 4. Main container 4 includes four walls 8, 10, 12 and 14, perpendicular to a common, substantially flat, sturdy bottom section 16, that form a geometric shape defining an enclosed internal volume and further defining an outer shell of main container 4. Front and back walls 8 and 10, and left and right side walls 12 and 14 respectively are of equal vertical height defining a contiguous horizontal rim 17 at the upper distal edge. The walls and bottom section comprise at least two layers of materials selected from the group of materials consisting of non-woven and woven flexible plastic, pliable woven fabric and durable woven fabric, wherein a layer of thermal insulating material 20, such as foil or foam that is common to the manufacturing art, is sandwiched between the outer shell and an inner liner 22. Liner 22 comprises a continuous sheet of flexible, water-resistant material, such as vinyl or plastic, that is folded to define a chamber in such a manner that reduces or eliminates permeable seams. Liner 22 is attached to rim 17 and covers all exposed surfaces of insulation layer 20 and includes a flanged edge 25 whereby a thermally insulated compartment 18 is defined within the outer shell. Main container 4, insulation layer 20 and liner 22 combined together further define a sturdy semi-flexible shell that remains erect when unsupported.

Main container 4 includes a pair of left and right side compartments 24 extending outwardly from side walls 12 and 14. Side compartments 24 open to provide access to an internal volume via an opening at the top thereof. Main container 4 further includes a detachable compartment 28. Detachable compartment 28 comprises four walls 32, 34, 36 and 38 that form a geometric shape, perpendicular to a common, substantially flat, sturdy bottom section 39, defining an enclosed internal volume. The exterior of opposing walls 36 and 38 include handle rings 40 and 41 respectively, that are attached at the upper planar region of said walls. Detachable compartment 28 opens at the top 37, to provide access to the internal volume via a zippered opening.

Configurable case 2 further includes a handle assembly 78 comprising connectors 76, adjuster 74 and handle 70. Handle 70 is a flexible, adjustable strap that has connectors 76 securely affixed to each end. Connectors 76 are detachable plastic or metal hooks that connect to handle rings 72. Handle rings 72 are secured to the upper planar region of opposing outer shell side walls 12 and 14. Handle 70 is adjustable to various lengths by means of an adjuster 74. Handle assembly 78 is interchangeable with any one of a multitude of handle assemblies that are common to the manufacturing art. Handle assembly 78 is removable, transferrable and usable as an adjustable handle connectable to handle rings 40 and 41 of detachable compartment 28. Handle assembly 78 further provides a lifting means, enabling configurable case 2 to be hoisted by a person and carried, in reliance of said handle assembly.

Configurable case 2 next comprises a cover assembly 6. Cover assembly 6 is movable and operates as a cover for main container 4. Cover assembly 6 includes a back wall 50. Cover assembly 6 is connected along the lower edge region of back wall 50 to the upper edge region of back wall 10 of main container 4. The joinder of said walls defines a hinge point, such that, cover assembly 6 is hingedly operable and movable from a closed position of 0° to the full extent of an arc of about 270°. Cover assembly 6 further includes a non-limiting fastener, such as a zipper 30. Zipper 30 is U-shaped and affixed along the three contiguous bottom edges of the cover assembly and the three contiguous top edges of the main container that are not hinged.

Cover assembly 6 further includes an inner cover container 44. Cover container 44 comprises a substantially rectangular compartment including walls 45, 46, 48 and 50 perpendicular to a common flat, layered bottom section 58, that form a geometric shape defining an enclosed internal volume. Said walls and bottom section comprising materials similar to main container 4. Front and rear walls 48 and 50, and side walls 45 and 46, are all of equal vertical height. Bottom section 58 further comprising an inner layer 52, a layer of thermally-insulating material 53 and an outer liner 54, like thermally-insulated bottom section 16, so that when cover assembly 6 is urged to the closed position, bottom section 58 abuts flange 25 of the main container completing a sealed, enclosed, thermally-insulated compartment within configurable case 2, as shown in FIG. 2.

Cover assembly 6 includes a cover flap 56 that acts as a closure for container 44. Cover flap 56, comprising an outer layer 68 and an inner layer 69, which are fastened together at their peripheral boundaries defining a reinforced hemmed boundary 60. Said layers comprising material selected from the group consisting of non-woven and woven flexible plastic, pliable woven fabric and durable woven fabric or a combination thereof. One edge of hemmed boundary 60 is affixed to the upper edge region of back wall 50 defining a hinge 62, providing a means to operate cover flap 56 that opens to gain access to the internal volume.

Cover flap 56 further includes a pocket 64 defined within aforementioned layers 68 and 69. Pocket 64 includes a pouch 61 comprising an upper and lower layer of material 65 and 66 respectively, like container 44. Said pouch has three sides which are fastened together at their peripheral boundaries defining a reinforced hemmed boundary and an open top, that is inserted between layers 68 and 69 of cover flap 56. Layer 68 includes a reinforced opening 67 through which access to pocket 64 is gained. The open edge of pouch 61 is affixed to the surrounding edge of opening 67 and the corresponding region of the adjacent inner layer 69 by a means such as sewing, forming a hemmed opening. The hemmed opening acts to stiffen and reinforce opening 67, so that said stiffened opening 67 defines an open but restrictive access to pocket 64.

Referring now to FIG. 3, the movable, hinged cover assembly is shown in a partially open position, wherein cover container 44 is in a raised position of about 30° while cover flap 56 is shown in the closed position. Referring to FIG. 4 which shows the independent operation of cover flap 56, cover assembly 6 is shown in a partially open position, cover container 44 is in the closed position of 0°, and cover flap 56 is shown open to about 80°, thereby exposing the internal volume of cover container 44. The internal volume of cover container 44 includes a clear plastic bag 80 above a meshed pocket 90. Referring now to FIG. 5, cover container 44 is shown in an open position of about 90° exposing the internal volume of main container 4, while cover flap 56 is shown open to about 115° further demonstrating the independent operation of cover flap 56.

Cover assembly container 44 includes a removable clear bag 80 first shown in FIG. 4 and further detailed with FIGS. 6,7,8 and 9. Clear bag 80 comprising a transparent, one quart, flexible, substantially rectangular, plastic bag constructed with material selected from the group of materials consisting of heavy gauge plastic, vinyl or other material, such that clear bag 80 is compliant with regulations for the transportation of fluids on commercial airlines. Clear bag 80 includes a slidable closure 82 and a button hole 84 as displayed with FIG. 9 Button hole 84 is a reinforced slot defined in the corner region of clear bag 80, that is mated to button 86. Button 86 is attached to a raised post 88. Raised post 88 is affixed to bottom section inner layer 52 in the corner region formed by the perpendicular intersection of cover container walls 46 and 50.

Clear bag 80 is connected to cover container 44 by inserting button 86, through button hole 84, such that clear bag 80 is movable. Raised post 88 is of such height to provide sufficient clearance between cover container bottom section inner layer 52 and button 86. This clearance enables clear bag 80 to freely pivot around raised post 80, such that clear bag 80 is pivotally attached, as depicted by FIG. 6 in an enlarged, exploded view. FIG. 7 shows clear bag 80 pivoted around post 88 to a position of about 35°. FIG. 8 shows clear bag 80 pivoted to a position of about 115° extended beyond the distal borders of cover assembly 6. Looking to FIG. 9, clear bag 80 is shown fully detached from container 44, such that button 86 is removed from button hole 84.

Cover container 44 further includes a meshed pocket 90. Pocket 90 is comprised of a layer of flexible mesh affixed at the intersection of walls 45 and 46 and bottom section 58, positioned below clear bag 80 defining a stretchable, elastic like, flexible barrier that stretches to accept and secure a member of the invention herein below defined.

Detachable compartment 28 is securely affixed to front wall 8 of main container 4 with a tongue 96 and slot 92 as depicted by FIG. 1 and further detailed in an exploded view depicted by FIG. 10. Slot 92 is a horizontal opening in the exterior planar surface of the outer shell of front wall 8, providing access to a reinforced vertical shaft 94 established in the region between the layers defining wall 8. Shaft 94 receives tongue 96. Tongue 96, comprised of a rigid material, such as metal or plastic, is affixed to back wall 34 of detachable compartment 28. Tongue 96 is of sufficient size and durability to establish a firm connection between detachable compartment 28 and front wall 8 of main container 4, wherein the outer shell of front wall 8 is displayed as transparent exposing reinforced shaft 94. Detachable compartment 28 is securely attached to the outer shell of main container 4 in a manner that facilitates easy removal.

Detachable compartment 28 acts as an independent configurable case when detached from main container 4 and handle assembly 78 is transferred from main container 4 and connected to rings 40 and 41 located on opposing left and right side walls 36 and 38 of detachable compartment 28 respectively, as shown in FIG. 11. Tongue 96 is optionally configurable as a device for attaching detachable compartment 28 to a traveler's luggage strap or waist belt referring now to FIG. 12.

Configurable case 2 includes at least one collapsible container, referenced as main container 4 in the illustrated embodiment. A plurality of collapsible folds 100 are defined at the bottom region of walls 8,10,12 and 14 of main container 4. Folds 100 are oriented parallel to bottom section 16. Folds 100 are accordion-type folds, wherein the apex of each fold alternates inwardly and outwardly, drawing down a portion of said walls with each fold, when urged with downward pressure, thereby reducing the vertical height and internal volume of main container 4. Defined folds 100, when disposed to the collapsed position, are secured in place with a non-limiting retainer, such as strap 102 and snap 104, thereby realizing a smaller container, as shown in FIG. 13. Conversely, when strap 102 is released by snap 104, and folds 100 are urged upward, a greater internal volume and vertical height is defined as depicted by FIG. 14.

The travel preparedness system further includes at least one commercially available, resealable, container. FIG. 15 depicts three containers 150-152, shown as they might be stored within the internal volume of main container 4. Containers 150-152 are commonly available containers constructed of a material such as rigid or semi-rigid plastic. In one sense, containers 150-152 are useful to contain preparedness articles, selected from the group consisting of the array of preparedness articles 200-270, wherein the amount, size or shape of containers 150-152 is determined by such internal volume as is necessary to contain and confine said preparedness articles 200-270. Resealable plastic bags 240-242, with slidable closures, act as internal liners for resealable containers 150-152, and confine and contain preparedness articles 200-270 for storage. Containers 150-152 include corresponding resealable lids 153-155. In another sense, containers 150-152 are reconfigurable as food bowls suitable for use in the preparation, consumption or storage of food stuffs.

An array of preparedness articles 200-270 comprise the final aspect of present invention. FIG. 16 depicts a representation of travel preparedness articles 200-270 that are displayed to show a general placement of articles as they may reside in containers 150-152 and within the compartments comprising configurable case 2. Preparedness articles 200-270 include commercially available articles intended to prepare a traveler for a broad range of adversities, injuries or medical maladies, and includes articles that are useful to provide entertainment and also to prepare, consume or store food stuffs, selected from the group of preparedness articles including:

1. a plurality of foul weather gear, such as ponchos 200. Ponchos 200 include a rain hood and are folded into a substantially flat rectangular shape, and are interchangeable with hooded rain jackets.
2. at least one bungee cord 204, which is an elastic cord with hooks at each end that may be of various lengths.
3. a multifunction tool 214, comprising a flat and phillips head screw driver, bottle and can opener, a cutting device and pliers, wherein said multifunction tool is interchangeable with individual tools.
4. a plurality of sewing supplies 212, comprising various colored threads, sewing needles of different sizes, safety scissors and buttons. Commercially available sewing kits exist in various forms including thread wrapped around a cardboard sleeve or contained in a small plastic case may be used.
5. a plurality of eyeglass repair supplies 210 comprising a small flat head screw driver, nose pads, an eyeglass screw assortment and cleaning cloth. Commercially available eyeglass repair kits, found in various containers ranging from narrow plastic cylinders to small boxes with an operable covers, may be used.
6. cyanoacrylate glue, often known as super glue 208.
7. roll of adhesive tape or duct tape 206.
8. a plurality of personal case supplies 250 including a plurality of hair ties, a nail file, a toe-nail clipper and finger-nail clipper.
9. a portable illumination device with an integrated USB electronic device charger 202. The integrated portable illumination device/charger 202, in a preferred embodiment, is powered by a dynamo, activated by hand cranking or squeezing action.
10. a plurality of first-aid supplies 220 including band aids, sterile pad(s), a roll of tape, and antiseptic swab(s). Commercially available first aid kits found in various forms such as a rigid or flaccid case of plastic, vinyl or cloth may also be used.
11. a plurality non-prescription medications 222, selected from the group of non-prescription medications consisting of bismuth subsalicylate, loperamide, loratadine, and analgesic pain relievers, generally individually packaged in single dose packets.
12. a plurality of air filtering face masks 226 which are commercially available and are constructed of cloth or paper, and are flat or conically shaped.
13. a plurality of hand protective gloves 224, such as latex or nitrile gloves.
14. hand sanitizer 236 including liquids, or pre-moistened wipes.
15. playing cards 260.
16. a plurality of dice 262.
17. a writing instrument 264.
18. note paper 266.
19. documentation 270 including instructions for card or dice games.
20. a plurality of resealable plastic bags 240-242, selected from the group of flexible plastic bags consisting of various sizes such as one pint, one quart and one gallon.
21. a plurality of plastic cutlery 246 comprising a knife, fork and spoon, and napkin sealed within a plastic wrapper and may also include seasoning packets such as salt, pepper, and moistened disposable towelettes commonly known as wet wipes.
22. a removable thermally insulated soft-sided cooler bag may be included in some embodiments.
23. a radio A method of a travel preparedness including configuring and utilizing the travel preparedness system is described herein, where configurable case 2 supports a plurality of configurations and purposes including storage and use. Such that, in a native configuration 400, handle assembly 78 is stored within a compartment of configurable case 2 which is collapsed to its smallest size and wherein detachable compartment 28 is attached to wall 8 of main container 4, and multifunction tool 214 is positioned in detachable compartment 28 and further hand sanitizer is positioned within clear bag 80.

402 The steps to configure configurable case 2 from a native configuration, for use as a carry case by attaching handle assembly 78 include:

404 removing handle assembly 78 from a compartment of configurable case 2 and

406 connecting to configurable case 2 to handle rings 70 and 71 on exterior walls of configurable case 2 and

408 configuring handle assembly 78 to support one of a configuration as a shoulder bag, or as a hand bag, by adjusting the length of handle assembly 78 resulting in

410 configurable case 2 is now configured as a carry case including handle assembly 78

412 The steps for enlarging the configurable case from a native configuration by increasing a vertical height of the main container walls by unfolding the walls of the main container and establishing a larger internal volume and supporting the configurable case for use as carry-on luggage include:

414 unsnapping retaining fastener strap 102, disconnecting the snap 104 and releasing the compressed folds and

416 urging the folds open with a snapping action exerted between the upper and lower extremities and

418 smoothing the opened folds by hand along the planar region of the walls thus increasing the vertical wall height and then

420 securing the retaining fastener strap to the configurable case so that the strap does not hang loose thus

422 configurable case 2 is now configured with a full internal volume.

424 The steps for utilizing configurable case 2 for content access in compliance with the requirements for traveling with liquid containers on commercial airlines because the case so configured allows ready content access include:

426 lifting cover flap 56 of cover assembly 6 to an open position exposing clear bag 80, then

428 pivoting and lifting to exposing the liquid contents of clear bag 80 to security personnel and

430 exposing liquids to security personnel and if required by security personnel,

432 removing clear bag 80 from cover assembly 6 by lifting the corner region of clear bag 80 and

434 unfastening button 86 on post 88 from button hole 84 on clear bag 80.

436 The steps for configuring the travel preparedness system as a thermally insulated compartment used as cooler for maintaining the temperature of liquid and solid food stuffs, and as an aid for preparing and consuming meals and storing food stuffs during travel or after a destination has been reached include:

438 removing all resealable containers 150-152 from the internal volume of thermally insulated main container 4 and then

440 removing at least one resealable bag 240-242 containing confined preparedness articles from at least one resealable container 150-152, and verifying the resealable container remains clean or cleaning the resealable container and reconfiguring resealable containers 150-152 from storage containers to food bowls useful for the consumption or preparation of food stuffs then

442 removing preparedness articles from the resealable flexible bags and

444 filling at least one resealable plastic bag 240-242 with available ice, sealing said bag, and positioning said bag within main compartment 4 and

446 configuring the resealable containers for use as food bowls and using plastic cutlery in conjunction with food bowls for preparing or consuming a meal and further using moistened towelettes for cleaning, and additional plastic bags for storing food.

448 Steps for removing detachable compartment 28 from configurable case 2 thus rendering configurable case 2 to a smaller configuration by detaching and separating detachable compartment 28 from main container 4 include:

450 grasping top of configurable case 2 and bottom of detachable compartment 28 and

452 pressing down on cover flap 56 while exerting an upward lifting pressure to the bottom of detachable compartment 28 while

454 simultaneously releasing tongue 96 from slot 92 of main container 4 by pulling the detachable compartment upward and outward while simultaneously applying downward pressure to cover assembly 6 and

456 separating the detachable compartment from configurable case 2 resulting in a configuration comprising two separate cases wherein

458 configurable case 2 is configured with a reduced exterior volume and a reduced width, or

460 detachable compartment 28 is now detached and acting as a separate case.

462 Steps to reduce the vertical wall height size and internal volume of configurable case in order to configure configurable case 2 for placement within luggage for storage or travel include:

464 reducing the vertical height of the walls and the internal volume of the configurable case, by exerting downward pressure on the upper region of configurable case 2 and

466 simultaneously urging the walls of main container 4 downward, compressing folds 100.

468 arresting an unfolding inclination of the compressed walls and maintaining the reduced vertical height and volume by securing folds 100 with retainers strap 102 and snap 104, by positioning the retaining straps perpendicularly across the compressed folds, at opposing sides of configurable case 2 and connecting to a snap on a bottom region of configurable case 2.

470 adjusting handle assembly 78 to a the shortest length and then

472 disconnecting handle assembly 78 and

474 storing handle assembly 78 in a compartment of configurable case 2.

482 Detached, detachable compartment 28, acting as a separate usable configurable case, can be configured with a handle assembly by connecting handle assembly 78 to rings 40 and 41 then

484 adjusting handle strap 70 to a desired length by threading strap 70 through adjuster 74 then

486 optionally configuring detachable compartment 28, acting as a separate case, as a shoulder bag or

488 optionally configuring detachable compartment 28, acting as a separate case, as a waist pack or

490 optionally configuring detachable compartment 28, acting as a separate case, as a hand bag or

492 Detached, detachable compartment 28, acting as a separate usable configurable case, can be configured without a handle assembly and

494 acting as either a clutch type bag or

496 attached to a belt or luggage strap using tongue 96.

498 The steps for configuring detachable compartment 28, acting as a separate case, as a miniature preparedness kit include:

500 identifying articles restricted commercial flights including, at least the multifunction tool

502 transfer restricted articles at least the multifunction tool, to the configurable case so that configurable case 2 with restricted articles is placed within checked luggage

504 selecting articles, as determined by a traveler defining a subset of articles for inclusion in detachable compartment 28 acting as a separate case from preparedness articles then

506 attaching handle assembly 78, if not already attached and

508 adjusting handle assembly 78 to a preferred configuration resulting in

510 detachable compartment 28, acting as a separate case configured as a miniature preparedness kit, and enabling a traveler to configure detachable compartment 28 acting as a separate case for use as a carry-on case.

What is claimed:

1. A travel preparedness system that supports travel emergencies and traveler preparedness, comprising:

a configurable case, comprising:

a main container with a main container internal volume, the main container including:

a thermally insulated compartment and handle rings;

a plurality of fixed and detachable compartments;

a cover assembly comprising:

an inner cover container with an inner cover container internal volume a cover flap comprising multiple layers of material, wherein a pouch is defined within a pocket between the multiple layers, such that an opening in the cover flap allows access to the internal volume of the pocket and;

a flexible mesh pocket; and a pivotally affixed, removable clear bag that includes a closure and a button hole and;

a configurable lifting means comprising: a handle assembly includes:

a flexible, detachable handle strap, a connecting device and an adjusting device;

wherein handle rings are affixed to opposing main container walls and/or the detachable compartment walls;

an array of preparedness articles;

a plurality of commercially available, resealable containers for storing preparedness articles, which are configurable to additionally contain liquid, dry food stuffs or both;

are suitable for containing liquid or dry food stuffs; and wherein the containers reconfigured for food functions, cooperate with the insulated compartment to maintain any food stuffs prepared therein.

2. The travel preparedness system of claim 1, wherein the main container further comprises:

a plurality of walls defined by a geometric shape of the container and a bottom section, wherein the walls and bottom section form an outer shell of the main container and thereby enclosing the main container internal volume.

3. The travel preparedness system of claim 2, wherein the walls and bottom section comprising materials selected from the group consisting of non woven and woven flexible plastic, pliable woven fabric and durable woven fabric.

4. The travel preparedness system of claim 2, wherein an upper portion of the outer shell defines a contiguous rim at upper distal vertical edges of the plurality of walls; and wherein a contiguous rim at upper distal vertical edges of the plurality of walls; and wherein the a layer of thermal insulating material comprising foil or foam is sandwiched between the outer shell and an internal liner effecting said thermal insulation.

5. The travel preparedness system of claim 4, wherein the liner a flexible, water resistant material selected from the group of material comprising plastic, vinyl, polyvinyl, rubber and combinations thereof.

6. The travel preparedness system of claim 4, wherein the liner is one contiguous piece and is folded within the container in a manner that eliminates or minimizes seams, wherein the folded liner includes a flange at the upper distal edge that abuts the contiguous rim that supports the water resistance of the compartment.

7. The travel preparedness system of claim 4, wherein the walls of the semi-flexible container are collapsible and wherein a bottom portion of walls fold along a plurality of predefined folds in order to enable folding along the predefined folds thereby reducing a vertical height and the internal volume.

8. The travel preparedness system of claim 7, wherein the folds are secured with a retainer to maintain the reduced internal volume realizing a smaller container and wherein removing the retainer allows the container to be expanded against the folds to maximize the internal volume.

9. The travel preparedness system of claim 1, wherein the detachable compartments comprise walls rising vertically from, and perpendicular to a common substantially flat, sturdy bottom and a top section to define an enclosed internal volume which opens to provide access via an opening means and wherein the detachable compartment is detachably affixed to one wall the main container using a slot and tongue.

10. The travel preparedness system of claim 9, wherein the tongue is urged into a vertical shaft established in the region between layers of the main container wall, via a horizontal slot cut into an outer surface main container wall, and wherein the tongue comprises a rigid material of sufficient size and durability to establish a firm connection between said wall and detachable compartment and to facilitate easy removal while remaining securely attached to the main container when not so disposed, wherein the detachable compartment acts as an independent container or by means of the tongue is alternatively clipped to waist belt or luggage strap.

11. The travel preparedness system of claim 1, wherein the cover assembly inner cover container comprises: a plurality of walls defined by a geometric shape of the container and a thermally insulated bottom section, like the main container, and further includes a cover flap, such cover flap is hingedly attached to the inner cover container to both cover and allow access to the internal volume of the inner cover container.

12. The travel preparedness system of claim 11, wherein the pivotally affixed clear bag comprises a one quart, transparent, flexible plastic bag that includes a closure and a button hole wherein the button hole is connectable to a button affixed to the bottom region of the cover container such that the pivotally affixed clear bag pivots around the button beyond the distal boundaries of the cover container.

13. The travel preparedness system of claim 12, wherein the button attached to a raised post that is connected to or integrally part of the clear bag is inserted through the button hole such that, when urged, the clear bag pivots.

14. The travel preparedness system of claim 1 wherein the lifting means handle assembly comprises:

a flexible, adjustable and detachable handle, an adjusting device for adjusting the length of the handle and a connecting device for connecting the handle assembly to the handle rings, wherein the case is hoisted by a person and carried in reliance on the lifting means.

15. The travel preparedness system of claim 1 wherein commercially available preparedness articles are selected from a group consisting of rain gear, including a hooded ponchos;

a portable illumination device;

a portable USB electronic device charger;

sewing supplies including needles, threads of various colors, buttons, and scissors; eye glass repair supplies including nose pads, small screws, a jewelers screwdriver and cleaning cloth;

a multifunction tool including at least flat and phillips head screw drivers; bottle and can opener; a cutting device and pliers;

a roll of adhesive cloth tape, often known as duct tape;

a tube of cyanoacrylate glue, commonly known as super glue;

a bungee cord, which may be of varying lengths;

first aid supplies including: a plurality of band aids, antiseptic ointment, gauze and tape;

personal care supplies including hair ties, finger nail clippers, toe nail clippers and a mirror;

non prescription medications including individually packaged medications such as:

bismuth subsalic, loperamide, loratadine, and analgesic pain relievers;

a plurality of air filtering face masks;

a plurality of protective gloves;

hand sanitizer;

a plurality of plastic cutlery;

a plurality of various sized flexible resealable plastic bags;

a deck of playing cards;

plural dice;

writing paper;

a writing instrument and written instructions, including a method of use and operation of the system, travel tips and game playing instructions.

16. A method of a travel preparedness including using the travel preparedness system as defined by claim 1, the method comprising the steps of:

increasing a vertical height of the main container walls by unfolding the walls of the main container and establishing a larger internal volume and supporting the configurable case for use as carry-on luggage by unsnapping the retaining fastener disconnecting the snap and releasing the compressed folds and urging the folds open with a snapping action exerted between the upper and lower extremities and smoothing the opened folds by hand along the planar region of the walls thus increasing the vertical wall height.

17. A method of a travel preparedness including using the travel preparedness system as defined by claim 1, the method comprising the steps of:

using the case to comply with requirements for traveling with liquid containers on commercial airlines because the case so configured allows ready content access by lifting the cover flap of the cover assembly to an open position, exposing and pivoting the clear bag holding the liquid containers beyond the boundaries of the cover container thereby exposing the liquid containers to security personnel or, as required, removing the clear bag from the cover assembly.

18. A method of a travel preparedness including using the travel preparedness system as defined by claim 1, the method comprising the steps of:

reconfiguring the case to utilize the thermally insulated compartment as a cooler for maintaining the temperature of liquid and solid food stuffs as an aid for preparing meals or storing food stuffs by removing all resealable containers from the internal volume of the thermally insulated main container and removing preparedness articles contained in a resealable plastic bag using resealable plastic bags to make ice packs with available ice and configuring the resealable containers for use as food bowls and using plastic cutlery in conjunction with food bowls for eating.

19. A travel preparedness system that supports travel emergencies and traveler preparedness, comprising:

a case, comprising:

a lower container, wherein the lower container further comprises:

a plurality of walls defined by a geometric shape of the container and a bottom section, the walls and bottom section, wherein the walls and bottom section form an outer shell of a main container and thereby enclosing a main container internal volume, wherein the lower container walls are collapsible along defined folds such that the defined folds are folded to reduce a vertical height and internal volume of the lower container realizing a smaller container;

handle rings;

a removable, portable, thermally insulated container that acts as a liner for the lower container, wherein the removable, portable, thermally insulated container includes handle rings; and a detachable compartment with a detachable compartment internal volume wherein the detachable compartment includes:

handle rings and an opening for access to the detachable compartment internal volume and a fastener;

a cover assembly comprising:

an upper container with an upper container internal volume;

a mesh pocket;

a fastener, such as a button;
a one quart clear plastic bag, wherein the one quart clear plastic bag is
movably affixed to the upper container with a fastener, such as a button, in a
manner that supports
pivoting the one quart clear plastic bag beyond the distal edges of the cover assembly
enabling visual and content access to the one quart clear plastic bag;
a cover flap, wherein the cover flap acts as a closure for the cover assembly wherein
the cover flap comprises: multiple layers of material, wherein
a pocket is defined between the multiple layers
an opening in the cover flap allows access to the internal volume of the pocket;
a configurable lifting means comprising: a handle assembly including:
a flexible, detachable handle,
a connecting device and
an adjusting device;
wherein the handle assembly connects to the handle rings affixed to opposing main container
walls; such that
the handle assembly is transferable to opposing walls of the detachable compartment and
the handle assembly is transferable to opposing walls of the removable, portable
thermally insulated container that acts as a liner for the lower container;
an array of preparedness articles wherein commercially available preparedness articles are selected from a group consisting of:
rain gear, including a hooded ponchos;
a portable illumination device;
a portable USB electronic device charger;
sewing supplies including needles, threads of various colors, buttons, and a safety scissor;
eye glass repair supplies including nose pads, small screws, a jewelers screwdriver and cleaning cloth;
a multifunction tool including at least flat and phillips head screw drivers; bottle and can opener; a cutting device and pliers;
a roll of adhesive cloth tape, often known as duct tape;
a tube of cyanoacrylate glue, commonly known as super glue;
a bungee cord, which may be of varying lengths;
first aid supplies including: a plurality of band aids, antiseptic ointment, gauze and tape;
personal case supplies including a hair ties, finger nail clippers, toe nail clippers and
a mirror;
non prescription medications including individually packaged medications such as:
bismuth subsalic, loperamide, loratadine, and analgesic pain relievers;
a plurality of air filtering face masks;
a plurality of protective gloves;
commercially available hand sanitizer;
a plurality of plastic cutlery;
a plurality of various sized flexible resealable plastic bags;
a deck of playing cards;
plural dice;
writing paper;
a writing instrument and
written instructions, including a method of use and operation of the system, travel tips and game playing instructions;
a plurality of commercially available, resealable containers for storing preparedness articles, which are configurable to additionally contain liquid, dry food stuffs or both;
are suitable for containing liquid or dry food stuffs; and
wherein the containers reconfigured for food functions, cooperate with the insulated compartment to maintain any food stuffs prepared therein.

20. A method of travel preparedness using a travel preparedness system including, a configurable case comprising: at least one main container; a thermal insulated compartment; a cover assembly further including at least one container and a pivotally affixed clear bag; fixed and/or detachable compartments; a handle assembly and a number of configurable resealable containers and an array of preparedness articles, during travel related emergency and non emergency situations, the method comprising the steps of:
increasing a vertical height of the main container walls by unfolding the walls of the main container and establishing a larger internal volume and
supporting the configurable case for use as carry-on luggage by unsnapping a retaining fastener
disconnecting a snap and
releasing compressed folds and
urging the folds open with a snapping action exerted between the upper and lower extremities and
smoothing opened folds by hand along the planar region of the walls thus increasing the vertical wall height and
using the case to comply with requirements for traveling with liquid containers on commercial airlines because the case so configured allows ready content access by lifting the cover flap of the cover assembly to an open position, exposing and
pivoting the clear bag holding the liquid containers beyond the boundaries of the cover container thereby exposing the liquid containers to security personnel or, as required,
removing the clear bag from the cover assembly and
reconfiguring the case to utilize the thermally insulated compartment as a cooler for maintaining the temperature of liquid and solid food stuffs as an aid for preparing meals or storing food stuffs by
removing all resealable containers from the internal volume of the thermally insulated main container and
removing preparedness articles contained in a resealable plastic bag
using resealable plastic bags to make ice packs with available ice and
configuring the resealable containers for use as food bowls and
using plastic cutlery in conjunction with food bowls for eating.

* * * * *